United States Patent [19]

Omura et al.

[11] Patent Number: 5,012,932

[45] Date of Patent: May 7, 1991

[54] PAPER SHEET PROCESSING APPARATUS

[75] Inventors: Hideo Omura, Tokyo; Nobusato Maruyama, Musashino; Masatoshi Shioya, Yokohama; Yoshiaki Ashikawa, Yokosuka; Kazunori Kinoshita, Yokohama; Kozo Matsumoto, Kawasaki; Toshiyuki Miyano; Hitoshi Takahashi, both of Yokohama, all of Japan

[73] Assignee: Kabushiki Kaisha Toshiba, Kawasaki, Japan

[21] Appl. No.: 227,924

[22] Filed: Aug. 3, 1988

[30] Foreign Application Priority Data

Aug. 4, 1987 [JP] Japan ..... 62-195906
Aug. 5, 1987 [JP] Japan ..... 62-196573

[51] Int. Cl.[5] ..... B07C 5/34; B65B 27/08

[52] U.S. Cl. ..... 209/534; 53/53; 53/54; 53/500; 53/587; 209/551

[58] Field of Search ..... 209/534, 548, 551; 29/33.5, 33.52, 426.1, 426.3, 564.1, 564.3; 53/54, 498, 500, 587, 588, 53; 83/909, 924

[56] References Cited

U.S. PATENT DOCUMENTS

| | | | |
|---|---|---|---|
| 4,025,420 | 5/1977 | Horino | 209/534 |
| 4,236,639 | 12/1980 | Boettge et al. | 209/534 |
| 4,376,364 | 3/1983 | Horino et al. | 53/54 |
| 4,437,571 | 3/1984 | Ohmura et al. | 209/534 X |
| 4,458,816 | 7/1984 | Horino et al. | 209/551 X |
| 4,483,124 | 11/1984 | Ohba et al. | 209/534 X |
| 4,586,232 | 5/1986 | Ohmura et al. | 209/534 X |
| 4,722,443 | 2/1988 | Maruyama et al. | 209/534 |
| 4,845,917 | 7/1989 | Omura et al. | 209/534 X |

FOREIGN PATENT DOCUMENTS

| | | | |
|---|---|---|---|
| 52-29298 | 3/1977 | Japan | 209/534 |
| 2034286 | 6/1980 | United Kingdom . | |
| 2073718 | 10/1981 | United Kingdom . | |
| 2085412 | 4/1982 | United Kingdom . | |
| 2092355 | 8/1982 | United Kingdom . | |
| 2094531 | 9/1982 | United Kingdom . | |

*Primary Examiner*—Margaret A. Focarino
*Assistant Examiner*—Edward M. Wacyra

[57] ABSTRACT

Uninspected bundles of paper sheets are supplied to each of a plurality of pre-processors in units of bundles. Each pre-processor removes a band from the uninspected bundle, prints a serial number in association with the received paper sheets on the band, and holds the band. A number of reusable paper sheets from which the band is removed are counted by and stored in a corresponding inspection device. Each inspection device stores the serial number printed on the band by the preprocessor. In each inspection device, the paper sheets to be re-inspected are sorted by a separator card in units of bundles and stored as rejectable notes in a rejectable note cassette. A center console receives data such as a count result, band number, cassette number, card number, and the like, from each inspection device, and sequentially stores these data in units of inspection devices. When rejectable notes in units of bundles taken out from the cassette are inserted, a rejectable note processor fetches data such as the count result, band number, cassette number, card number, and the like from the center console, and performs discrimination of authenticity, detection of denominations, and counting and collation processing of the received rejectable notes.

9 Claims, 33 Drawing Sheets

RUN NO. = 1 BATCH NO. = 3

| I | | | | | | | | C/P | |
|---|---|---|---|---|---|---|---|---|---|
| CASSET NO. | BATCH CARD | BUNDLE NO. | | STRAP NO. | DATE | TIME | FIT | UNFIT | FIT + UNFIT |
| 5 | 0209 | 3 | 1045 | 46 | 06/14 | 10:28 | 95 | 5 | 100 |
| 5 | 0209 | 3 | 1045 | 47 | 06/14 | 10:28 | 90 | 10 | 100 |
| 5 | 0209 | 3 | 1045 | 48 | 06/14 | 10:28 | 95 | 5 | 100 |
| 5 | 0209 | 3 | 1045 | 49 | 06/14 | 10:28 | 89 | 11 | 100 |
| 5 | 0209 | 3 | 1045 | 50 | 06/14 | 10:28 | 97 | 3 | 100 |
| 5 | 0444 | 3 | 1046 | 51 | 06/14 | 10:28 | 94 | 6 | 100 |
| 5 | 0444 | 3 | 1046 | 52 | 06/14 | 10:28 | 96 | 4 | 100 |
| 5 | 0444 | 3 | 1046 | 53 | 06/14 | 10:28 | 95 | 5 | 100 |
| 5 | 0444 | 3 | 1046 | 54 | 06/14 | 10:28 | 91 | 8 | 99 |
| 5 | 0444 | 3 | 1046 | 55 | 06/14 | 10:29 | 91 | 9 | 100 |
| 5 | 0444 | 3 | 1046 | 56 | 06/14 | 10:29 | 98 | 2 | 100 |
| 5 | 0444 | 3 | 1046 | 57 | 06/14 | 10:29 | 98 | 2 | 100 |
| 5 | 0444 | 3 | 1046 | 58 | 06/14 | 10:29 | 96 | 4 | 100 |
| 5 | 0444 | 3 | 1046 | 59 | 06/14 | 10:29 | 94 | 6 | 100 |
| 5 | 0444 | 3 | 1046 | 60 | 06/14 | 10:29 | 96 | 4 | 100 |
| 5 | 0402 | 3 | 1047 | 61 | 06/14 | 10:29 | 96 | 4 | 100 |
| 5 | 0402 | 3 | 1047 | 62J | 06/14 | 10:29 | 96 | 3 | 99 |
| 5 | 0402 | 3 | 1047 | 63 | 06/14 | 10:30 | 93 | 6 | 99 |
| 5 | 0402 | 3 | 1047 | 64 | 06/14 | 10:30 | 95 | 5 | 100 |
| 5 | 0402 | 3 | 1047 | 65 | 06/14 | 10:31 | 93 | 6 | 99 |
| 5 | 0402 | 3 | 1047 | 66 | 06/14 | 10:31 | 96 | 3 | 99 |
| 5 | 0402 | 3 | 1047 | 67 | 06/14 | 10:31 | 96 | 4 | 100 |
| 5 | 0402 | 3 | 1047 | 68 | 06/14 | 10:31 | 89 | 9 | 98 |
| 5 | 0402 | 3 | 1047 | 69 | 06/14 | 10:31 | 94 | 6 | 100 |
| 5 | 0402 | 3 | 1047 | 70 | 06/14 | 10:31 | 92 | 4 | 96 |
| 5 | 0021 | 3 | 1048 | 71 | 06/14 | 10:31 | 92 | 7 | 99 |
| 5 | 0021 | 3 | 1048 | 72 | 06/14 | 10:31 | 96 | 4 | 100 |
| 5 | 0021 | 3 | 1048 | 73 | 06/14 | 10:31 | 95 | 5 | 100 |
| 5 | 0021 | 3 | 1048 | 74 | 06/14 | 10:31 | 91 | 9 | 100 |
| 5 | 0021 | 3 | 1048 | 75 | 06/14 | 10:31 | 95 | 4 | 99 |
| 5 | 0021 | 3 | 1048 | 76 | 06/14 | 10:31 | 96 | 4 | 100 |
| 5 | 0021 | 3 | 1048 | 77 | 06/14 | 10:32 | 96 | 4 | 100 |
| 5 | 0021 | 3 | 1048 | 78 | 06/14 | 10:32 | 92 | 7 | 99 |
| 5 | 0021 | 3 | 1048 | 79 | 06/14 | 10:32 | 91 | 9 | 100 |
| 5 | 0021 | 3 | 1048 | 80J | 06/14 | 10:32 | 91 | 4 | 95 |

272

274

FIG. 24

| MACHINE NO. | | TEAM NAME | | DENOMINATION DATA | |
|---|---|---|---|---|---|
| RUN NO. | CASSET NO. | CARD NO. | BATCH NO. | BUNDLE NO. | FIT+ UNFIT |
| 1 | 5 | 0444 | 3 | 1046 | 999 |
| 1 | 5 | 0402 | 3 | 1047 | 990 |
| 1 | 5 | 0021 | 3 | 1048 | 992 |

| CASSET NO. | CARD NO. | BATCH NO. | BUNDLE NO. | FIT+ UNFIT | RS- NOTE | OVER | SHORT | D1K | D5K | D10K | COUNTER-FEIT NOTE |
|---|---|---|---|---|---|---|---|---|---|---|---|
| 5 | 0444 | 3 | 1046 | 999 | 1 | 0 | 0 | 0 | 0 | 0 | 0 |

FIG. 28

17 JUNE 1988 10:07:50

EXCESS AMOUNT ¥ 40,000

EXCESS 4NOTES OTHERS : 6NOTES

| | | |
|---|---|---|
| D-¥5K | NOTES OF DIFFERENT DENOMINATIONS | 4 |
| D-¥1K | NOTES OF DIFFERENT DENOMINATIONS | 2 |

MACHINE #02
TEAM #4
D-¥10K
BAND #1020
RUN #001
CASSETTE #13
CARD #394

FIG. 29

PAPER SHEET PROCESSING APPARATUS

BACKGROUND OF THE INVENTION

1. Field of the Invention

The present invention relates to a paper sheet processing apparatus for unbinding a bundle consisting of paper sheets such as securities, and automatically performing predetermined processing such as inspection of the paper sheets one by one.

2. Description of the Related Art

As a conventional paper sheet processing apparatus of this type, those described in U.S. Pat. No. 4,586,232 to Ohumura et al. granted on May 6, 1986, and U.S. Pat. No. 4,722,443 to Maruyama et al. granted on Feb. 2, 1988 are known. In such apparatuses, articles to be examined, e.g., bank notes are sequentially taken out one by one, and their authenticity and fit/unfit states are examined. This apparatus normally receives not separate bank notes but a bundle of a predetermined number of bank notes bundled by a band. For example, a sheaf of 100 bank notes is bound by a strap, and a bundle is obtained by bundling 10 sheaves of bank notes by a band. The bundle is unbound, and 10 sheaves each bonded by a strap are manually inserted in the apparatus.

In the apparatus, the straps are cut to sequentially take out bank notes. Thereafter, the bank notes are sorted, based on an inspection result from an inspection device, into fit notes, unfit notes, and rejectable notes, which cannot be identified. The rejectable notes are stocked together with the cut straps.

The conventional apparatus requires several manual operations in a series of processing steps starting from bundles to rejectable note processing for bank notes requiring re-inspection through inspection processing. For this reason, a large number of bank notes cannot be quickly processed.

More specifically, in the conventional apparatus, the band of the bundle must be removed, and 10 sheaves must be inserted first. Upon completion of insertion, data on the strap of rejectable notes which cannot be inspected must be input, and the number of rejectable notes must be manually counted and input. Therefore, an operator is required to perform cumbersome manual operations. In addition, he cannot operate the inspection device body while a rejectable note processor processes rejectable notes. Therefore, the work efficiency of the apparatus may be decreased. When the rejectable note processor malfunctions, the inspection device body must be stopped. As a result, the work efficiency and processing power of the apparatus are considerably decreased. In this apparatus, since the inspection device and the rejectable note processing apparatus are arranged to have one-to-one correspondence, if the number of notes to be rejected is small, a working efficiency of the rejectable note processor is decreased, and the total function of the entire apparatus cannot be fully exhibited.

SUMMARY OF THE INVENTION

The present invention has been made in consideration of the conventional problem that a requirement of quick processing of bank notes cannot be met and a sufficient countermeasure is not taken against processing of inspected bank notes in the conventional apparatus described above, and has as its object to provide a paper sheet processing apparatus in which a series of processing operations associated with inspection of paper sheets are mostly automated so as to efficiently and quickly process a large number of paper sheets.

The present invention has been made in consideration of the conventional problem that in the conventional apparatus, working efficiencies of an inspection device and a rejectable note processor constituting the apparatus are different, and a total function cannot be fully exhibited, and has as its object to provide a paper sheet processing apparatus which can fully exhibit its function.

A paper sheet processing apparatus according to the present invention comprises:

a plurality of inspection device means for each inspecting the sheets, thereby discriminating between effective sheets and unidentifiable sheets, sorting the sheets into effective sheets and unidentifiable sheets, and counting a number of the effective sheets;

means for storing a counting result data from the plurality of inspection device means; and unidentifiable sheet processor means for counting a number of the unidentifiable sheets, and collating the sum of the number of the effective sheets and the number of the unidentifiable sheets with a set number.

According to an another aspect of the present invention, there is provided a paper sheet processing apparatus comprising:

bundle processor means for storing a plurality of uninspected bundles of sheets, sequentially feeding the stored uninspected bundles, sequentially receiving inspected bundles of sheets, and storing the received inspected bundles, each of the bundles being bound by a band;

bundle conveyor means for receiving the uninspected bundles from the bundle processor means and conveying the inspected bundles to the bundle processor means;

pre-processor means for receiving the uninspected bundles of sheets conveyed by the bundle conveyor means, separating the band from each of the uninspected bundles, printing association data in units of the received sheets on each band, and holding the bands;

inspection device means for receiving the sheets from which the band is removed by the pre-processor means, sorting the sheets into reusable sheets, non-reusable sheets, and unidentifiable sheets, counting a number of the reusable and non-reusable sheets, storing a count result data obtained by counting the number of the sheets, storing the association data printed on the band by the pre-processor means, performing binding processing for the reusable sheets using a band and sending them as an inspected bundle to the bundle conveyor means, performing one of binding processing using a band for the non-reusable sheets and invalidation processing, rejecting the unidentifiable sheets, and performing sorting and stocking processing in units of bands separated by the pre-processor means;

controller means for receiving and sequentially storing the count result data and data stored from the inspection device means and performing overall control of the paper sheet processing apparatus; and unidentifiable sheet processor means for receiving and counting the number of sheets rejected at the inspection device means, fetching the stored count result data from the controller means, and performing counting and collation processing.

BRIEF DESCRIPTION OF THE DRAWINGS

FIGS. 13A to 13C are views for explaining an arrangement of an inspection device, in which FIG. 13A is a plan view, FIG. 13B is a schematic front sectional view, and FIG. 13C is a side view;

Figure 21:
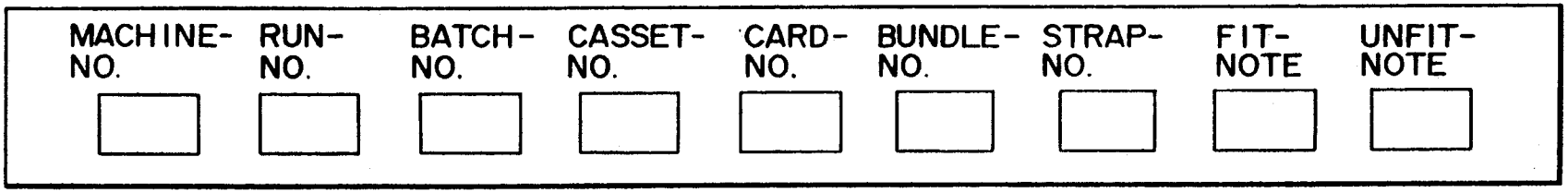
Figure 22:
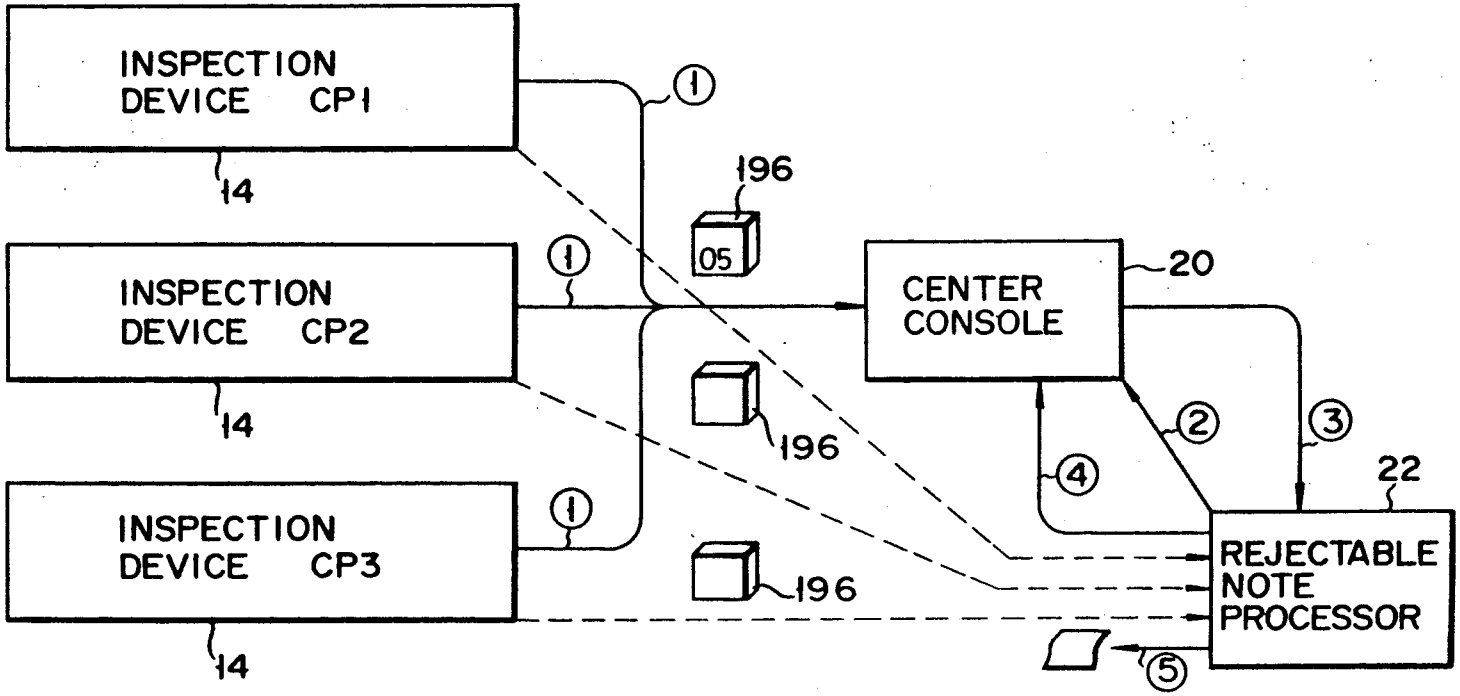
Figure 23:
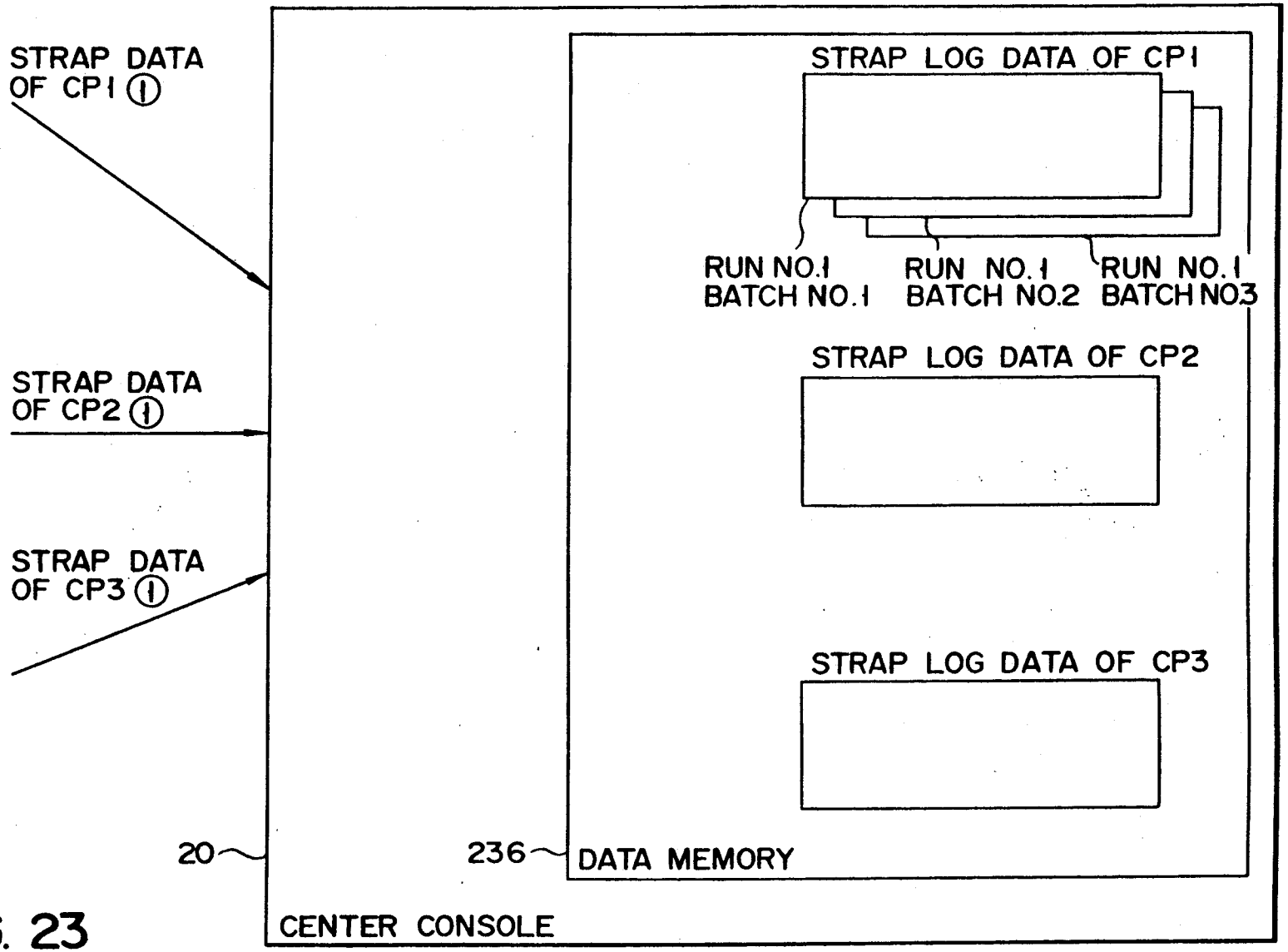
Figures 25, 27:
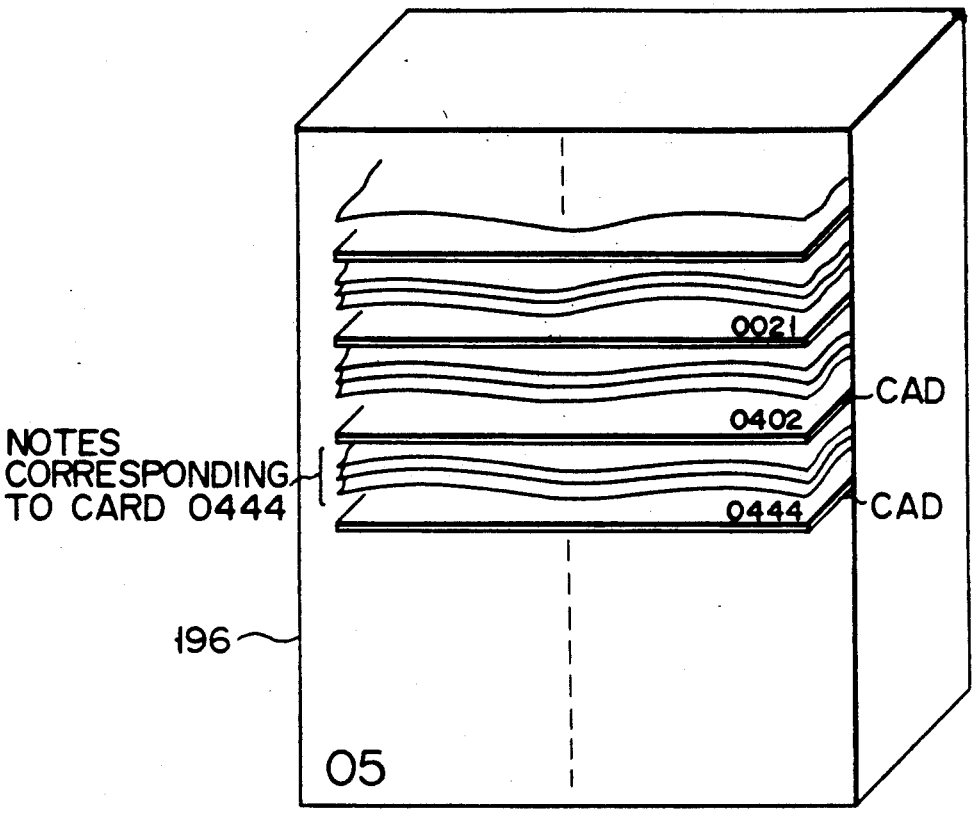
Figure 26A:
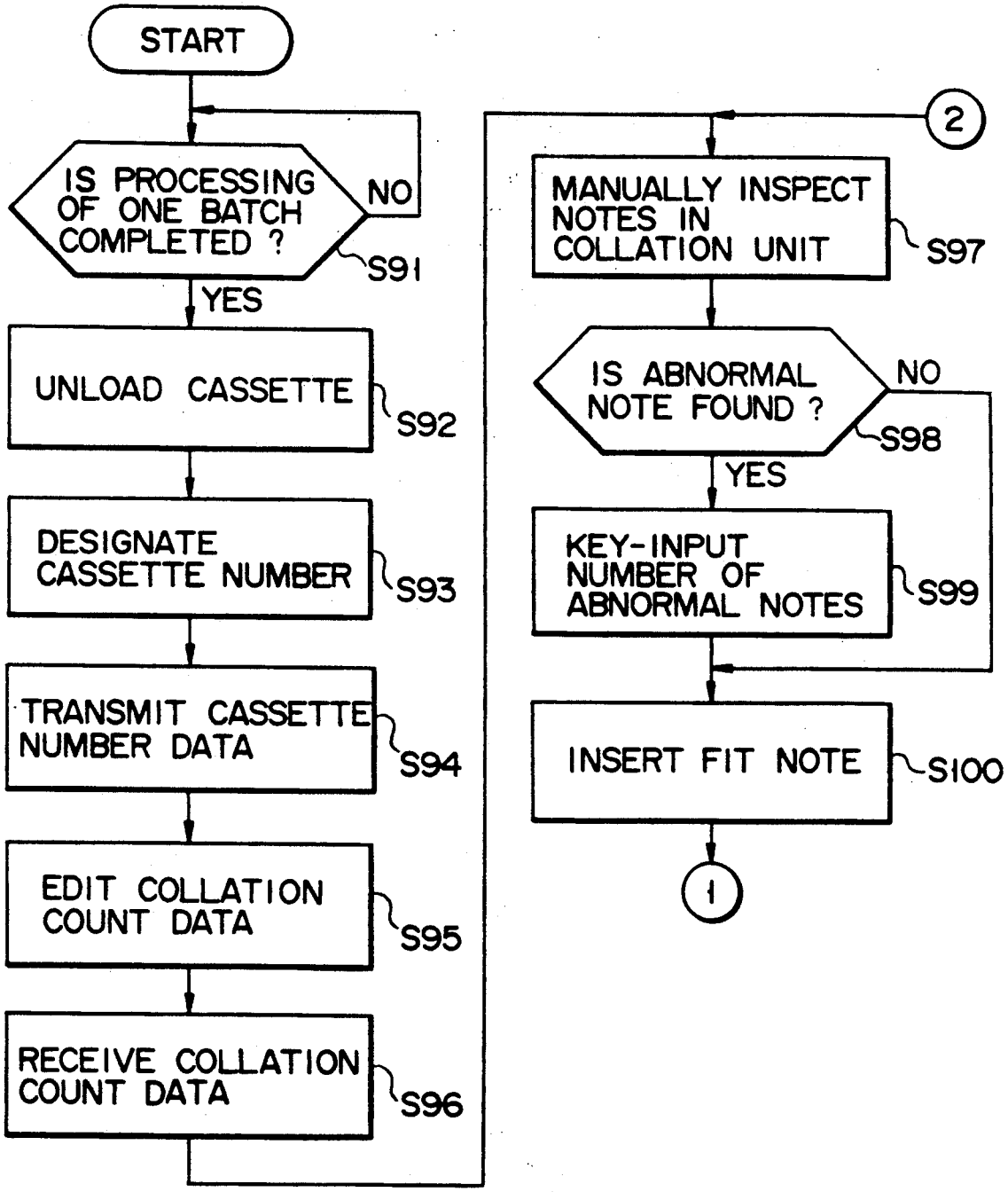
Figure 26B:
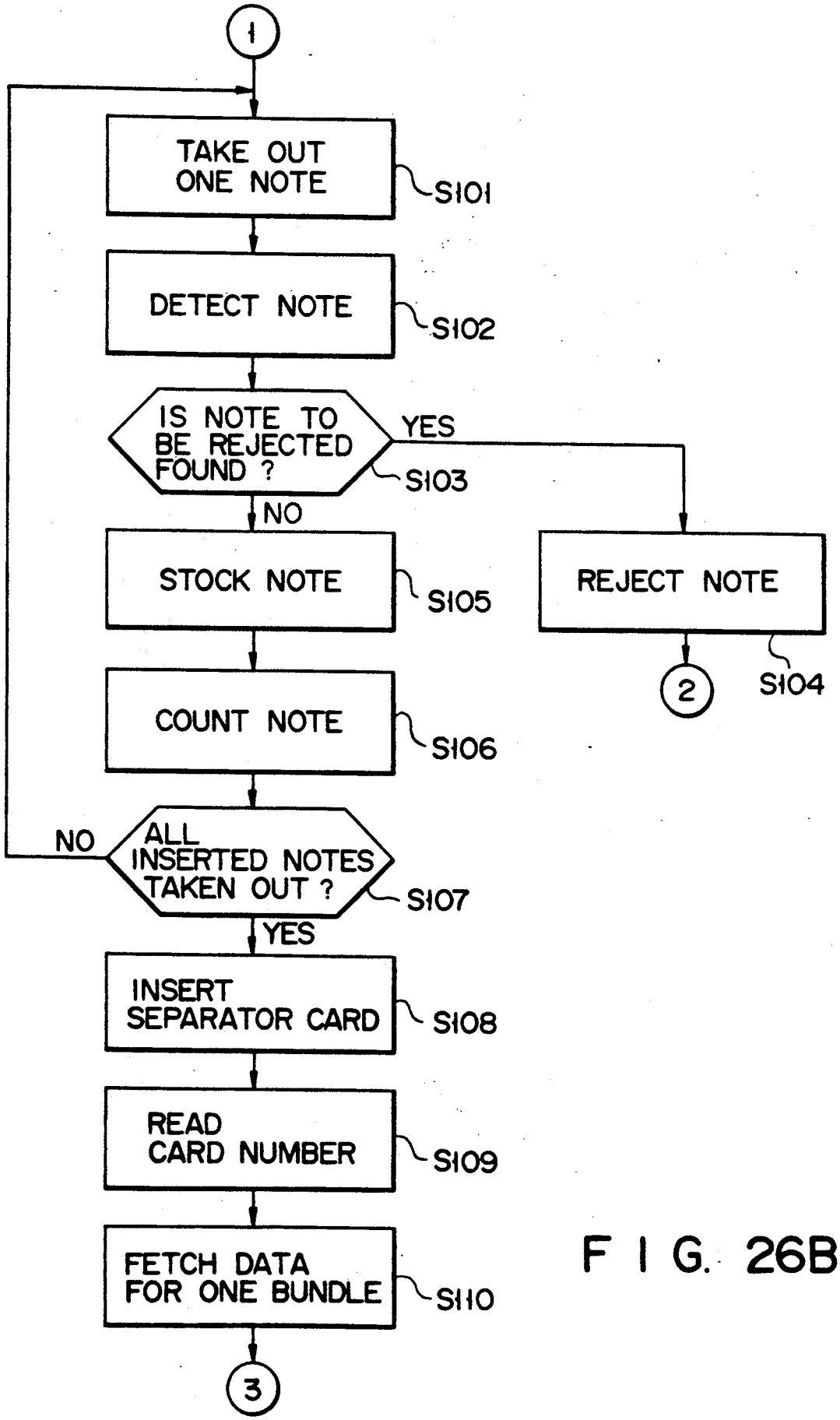
Figure 26C:
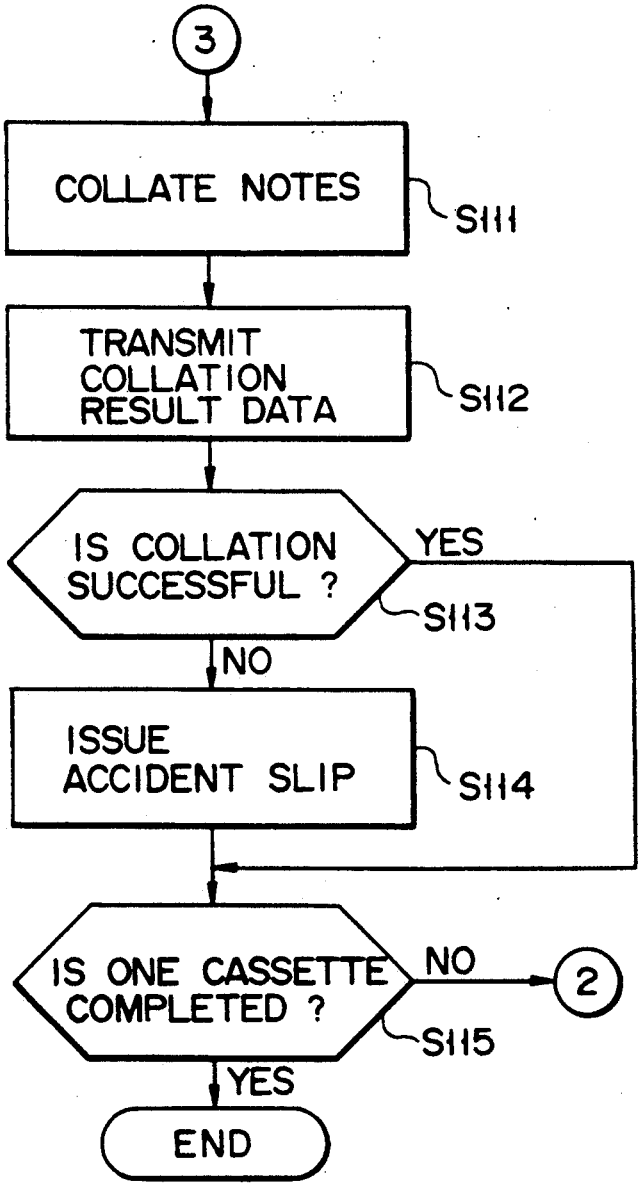
Figure 30:
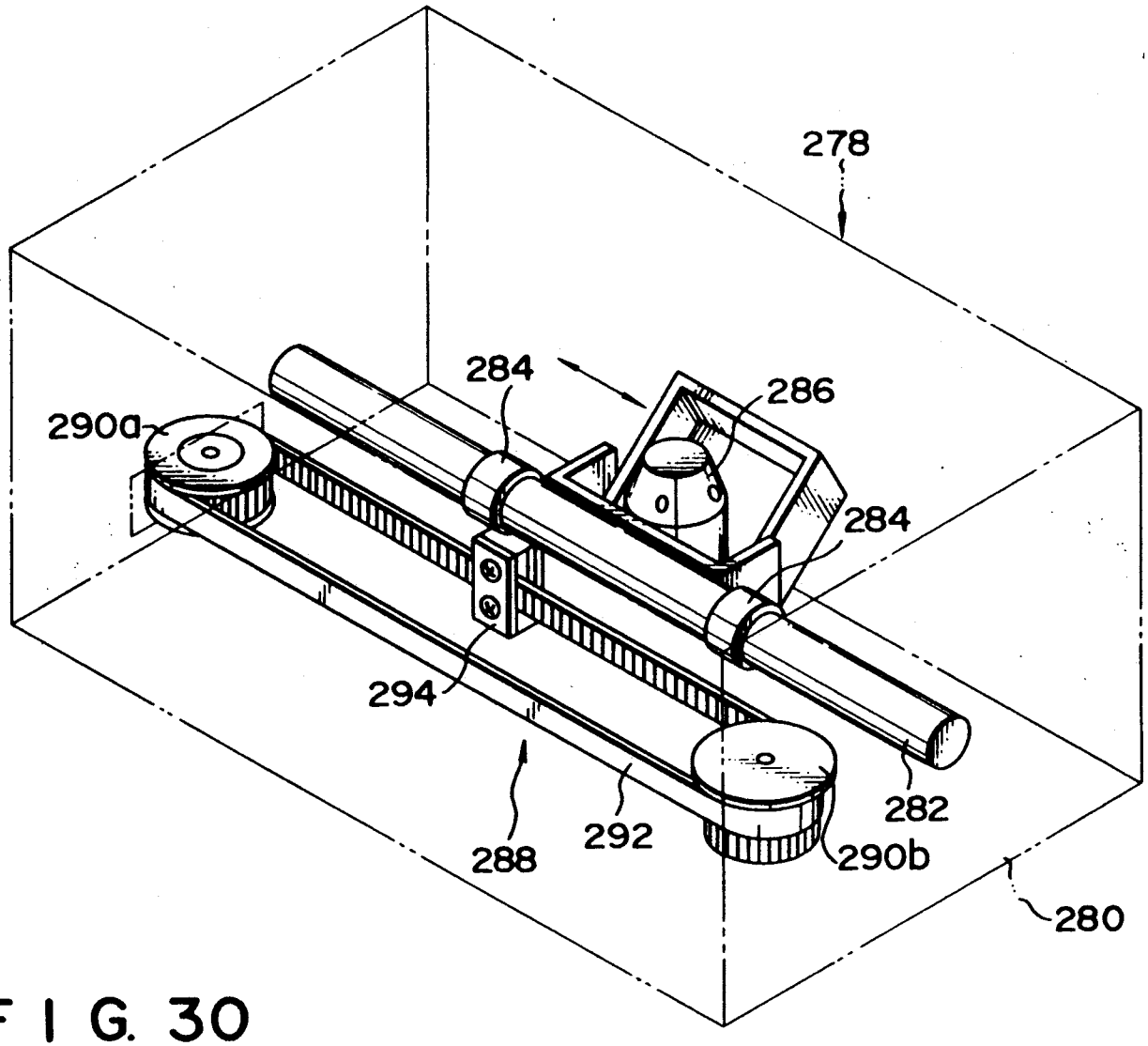
Figure 31:
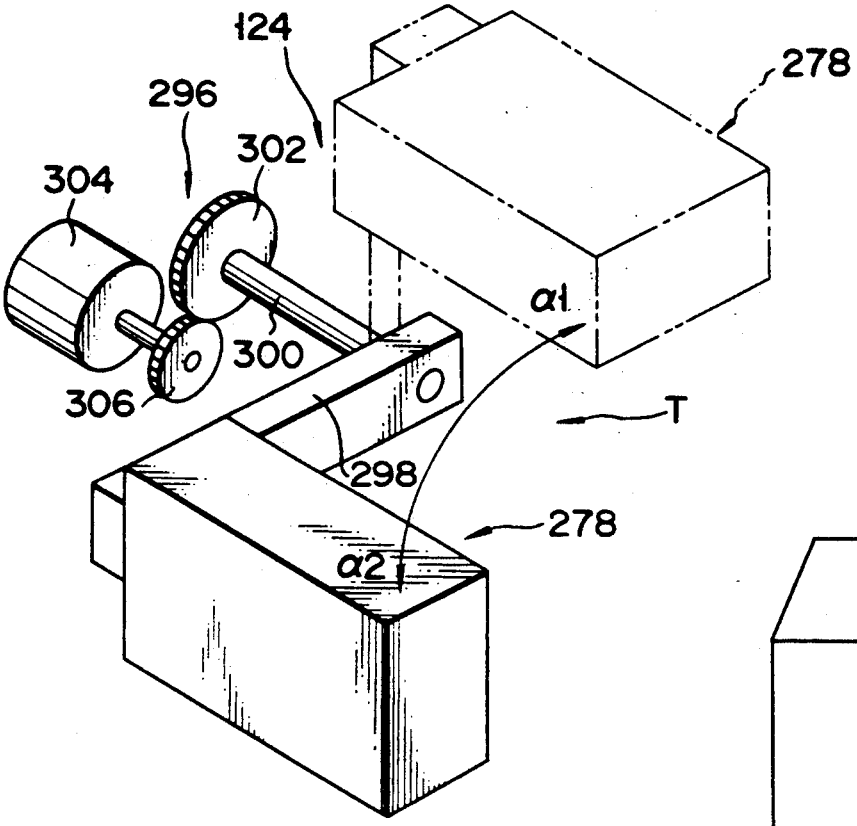
Figure 32:
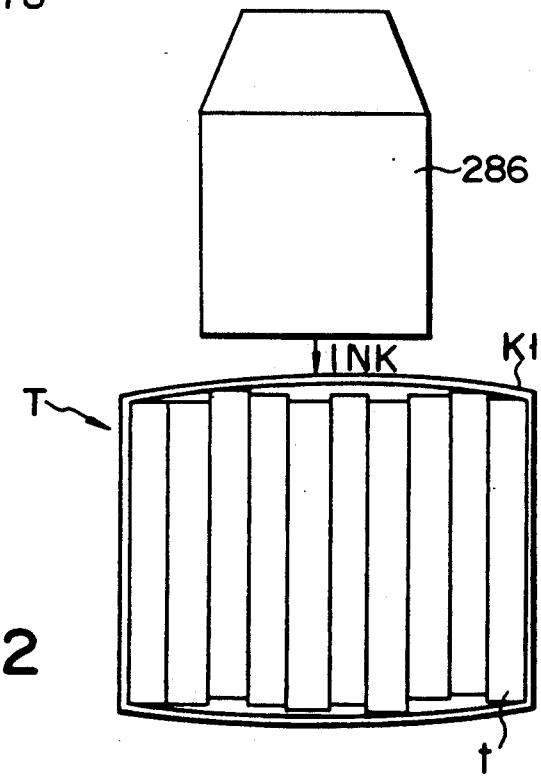
Figure 33:
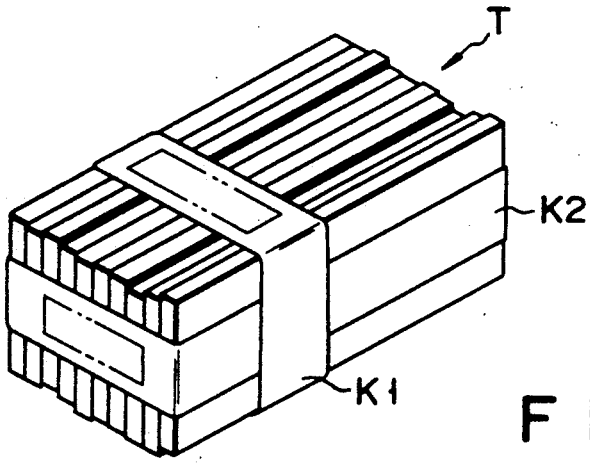
Figure 34A:
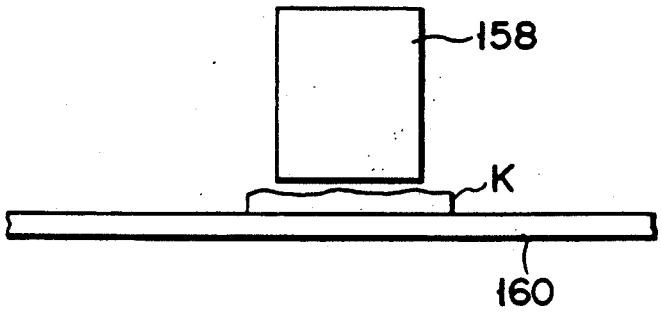
Figure 34B:
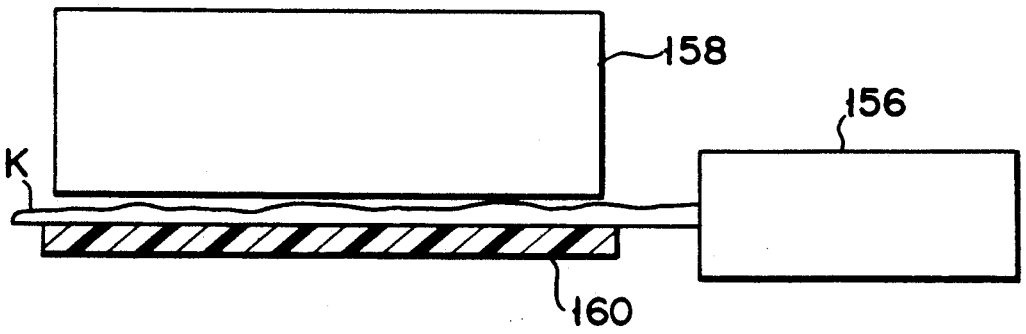
Figure 35A:
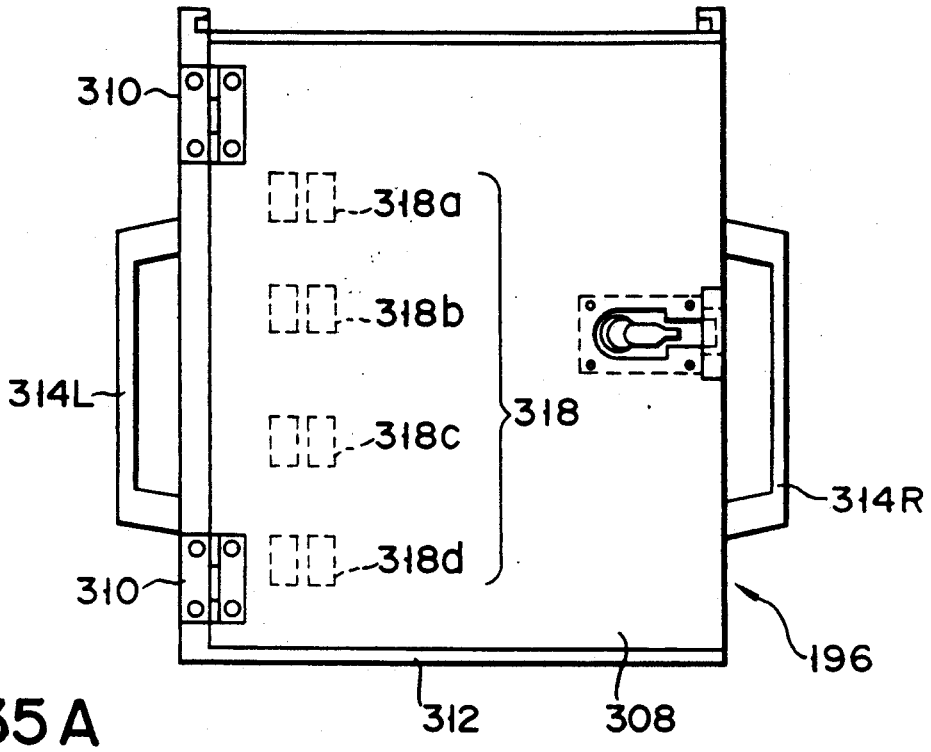
Figure 35B:
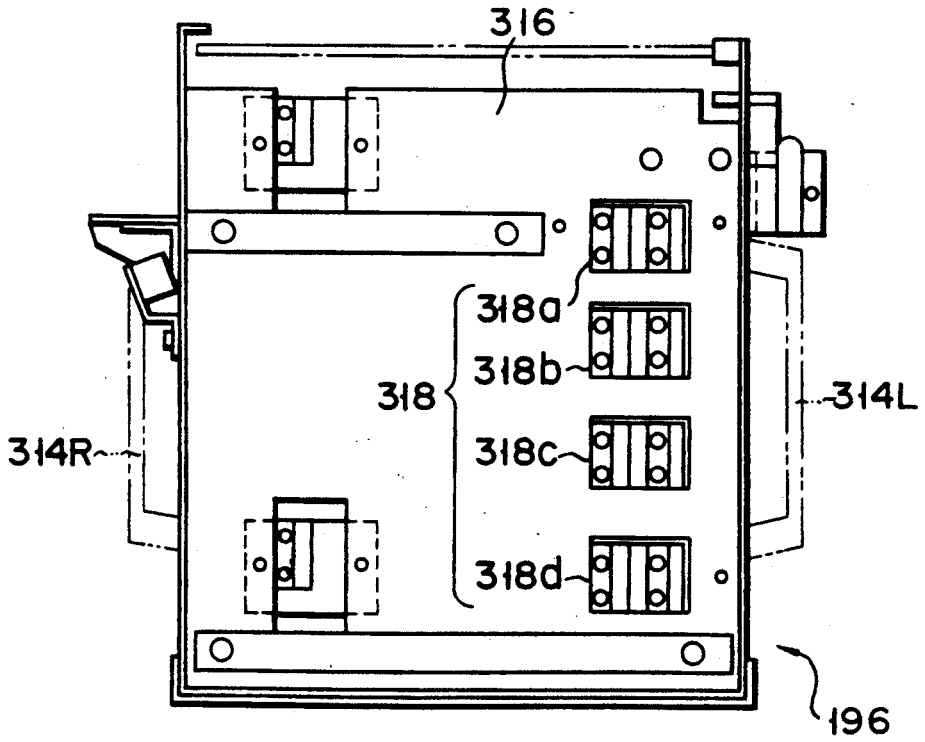
Figure 35C:
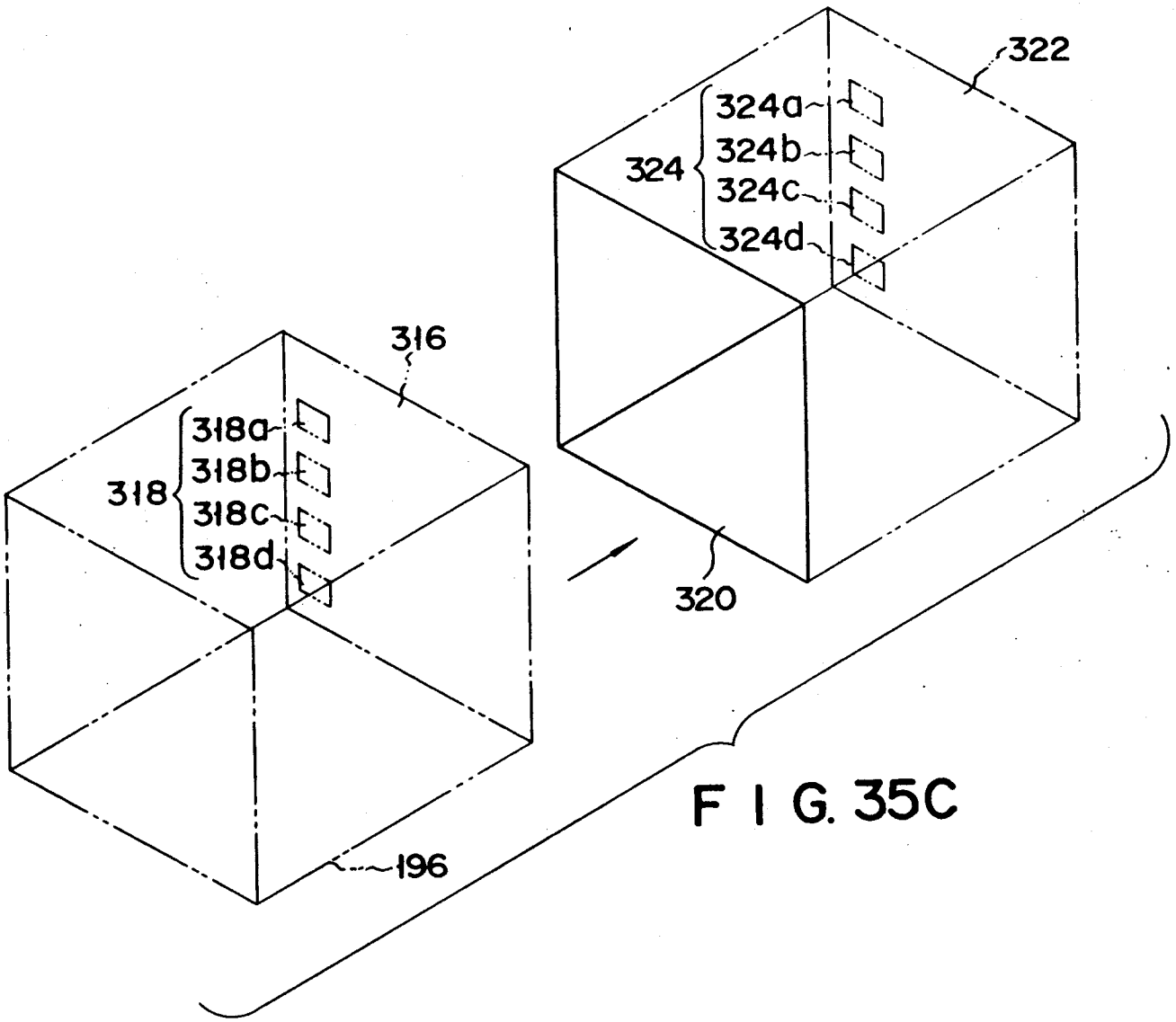

is a flow chart for explaining a bundle receiving operation in the bundle processor;

FIG. 21 is a view for explaining strap data;

FIG. 22 is a view for explaining a data flow among a center console, inspection devices, and the rejectable note processor;

FIG. 23 is a view for explaining a storage format of strap log data in the center console;

FIG. 24 is a view showing the strap log data in detail;

FIG. 25 is a view showing the relationship between a rejectable note stored in a rejectable note cassette and a separator card;

FIGS. 26A to 26C are flow charts of a rejectable note adjusting operation in the rejectable note processor;

FIG. 27 is a view for explaining collation count data;

FIG. 28 is a view for explaining collation result data;

FIG. 29 is a view showing an accident slip;

FIG. 30 is a view showing an arrangement in the main body of a band serial number printer;

FIG. 31 is a perspective view showing a pivoting mechanism of the band serial number printer;

FIG. 32 is a view for explaining the relationship between the band serial number printer and the band during printing;

FIG. 33 is a view showing a printed state:

FIGS. 34A and 34B are respectively a front view and a side view showing the relationship between a strap printer and a strap during printing;

FIGS. 35A and 35B are respectively a front view and a rear view showing an arrangement of a rejectable note cassette; and FIG. 35C is a view for explaining the relationship between the rejectable note cassette and the cassette loading/unloading section.

DETAILED DESCRIPTION OF THE PREFERRED EMBODIMENT

Figure 1:
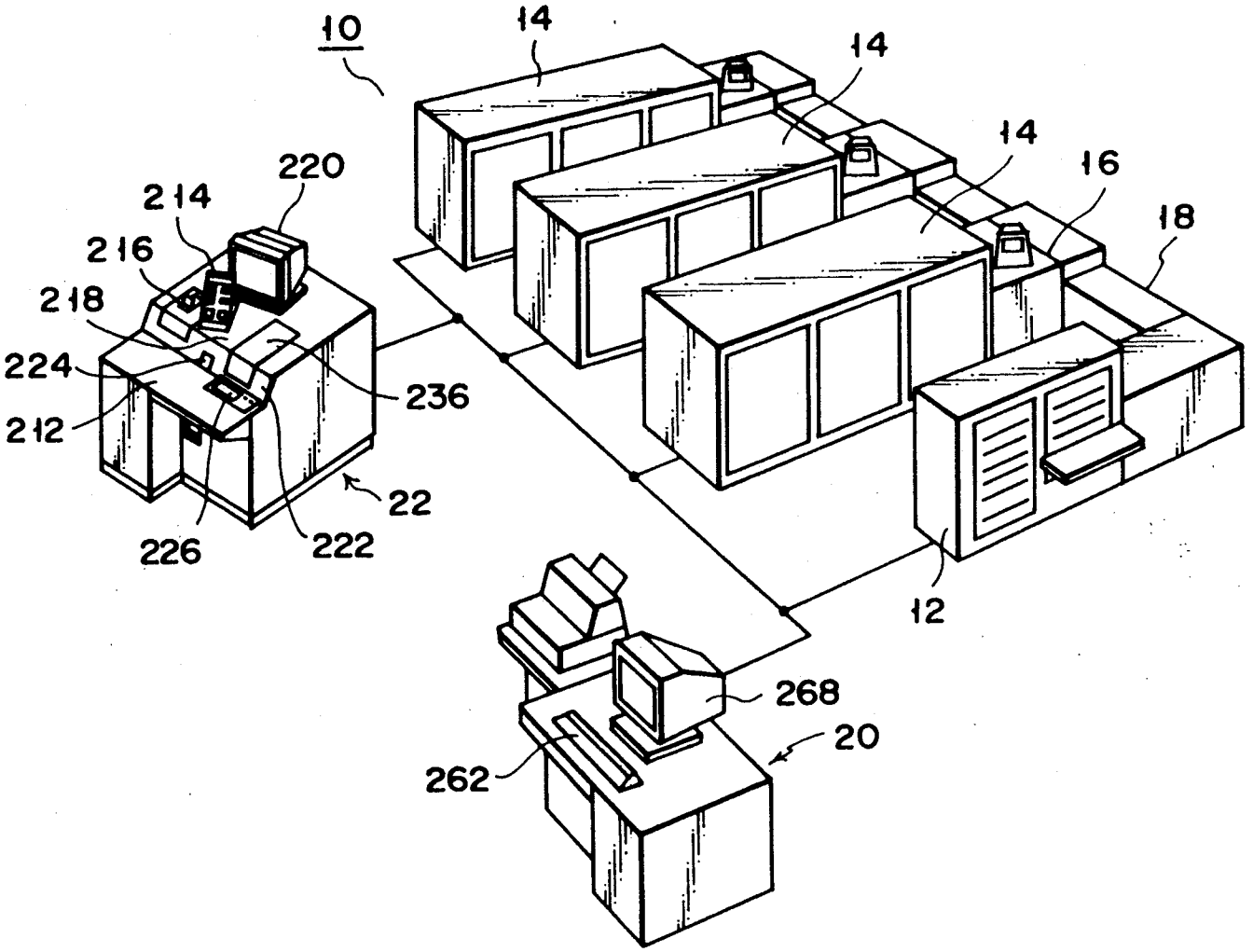
FIG. 1 is a perspective view showing an outer appearance of a paper sheet processing apparatus according to an embodiment of the present invention.

FIG. 1 shows paper sheet processing apparatus 10 according to an embodiment of the present invention. Bundle processor 12 is connected to a plurality of sets of inspection devices 14 and pre-processors 16 constituting inspection processing means through conveyor 18 as a bundle conveying device. Center console 20 as a control means controls these constituting devices and rejectable note processor 22 (to be described later).

Figure 2A:
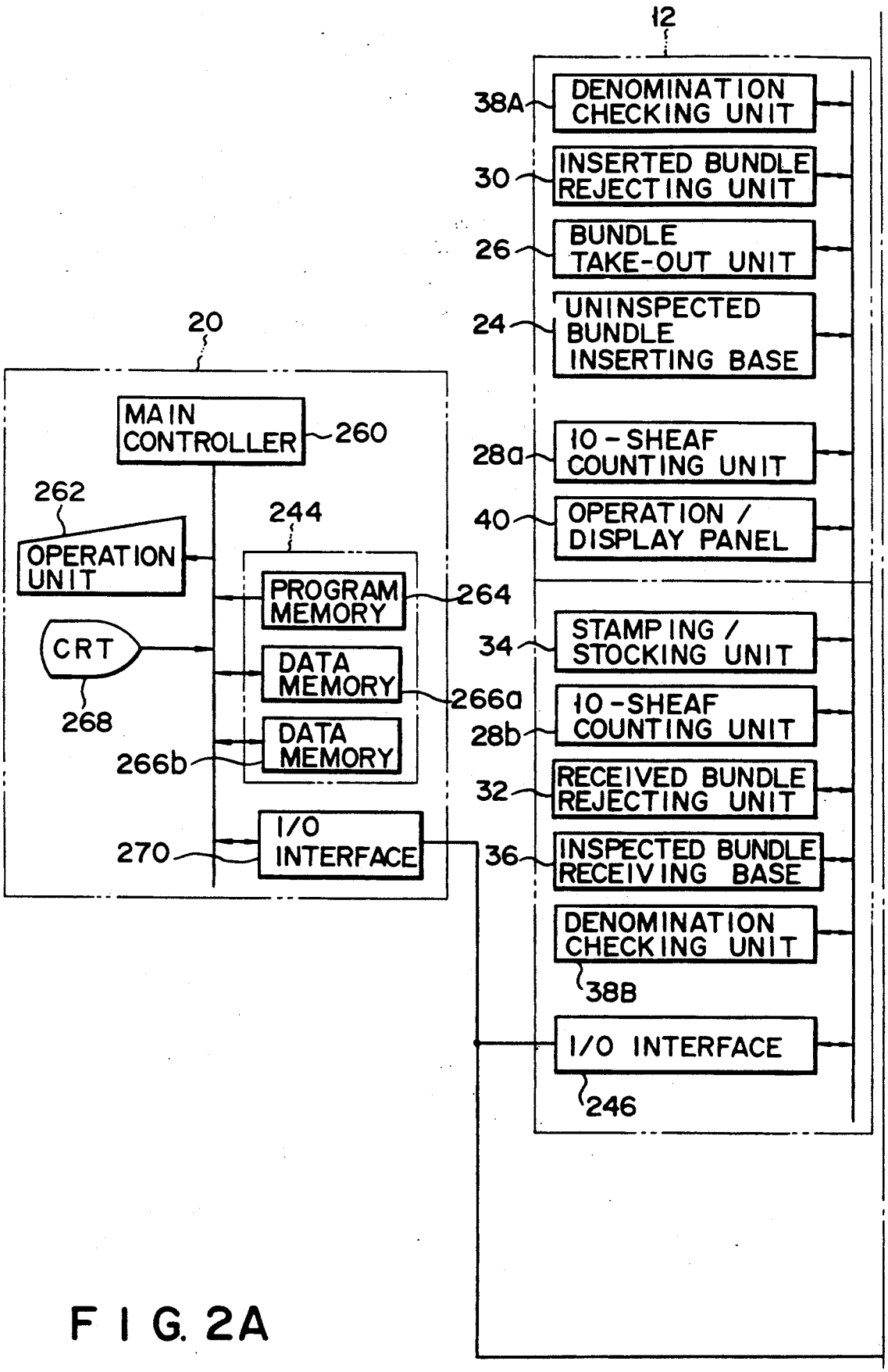
FIGS. 2A and 2B are block diagrams showing an arrangement of the apparatus shown in FIG. 1.
Figure 2B:
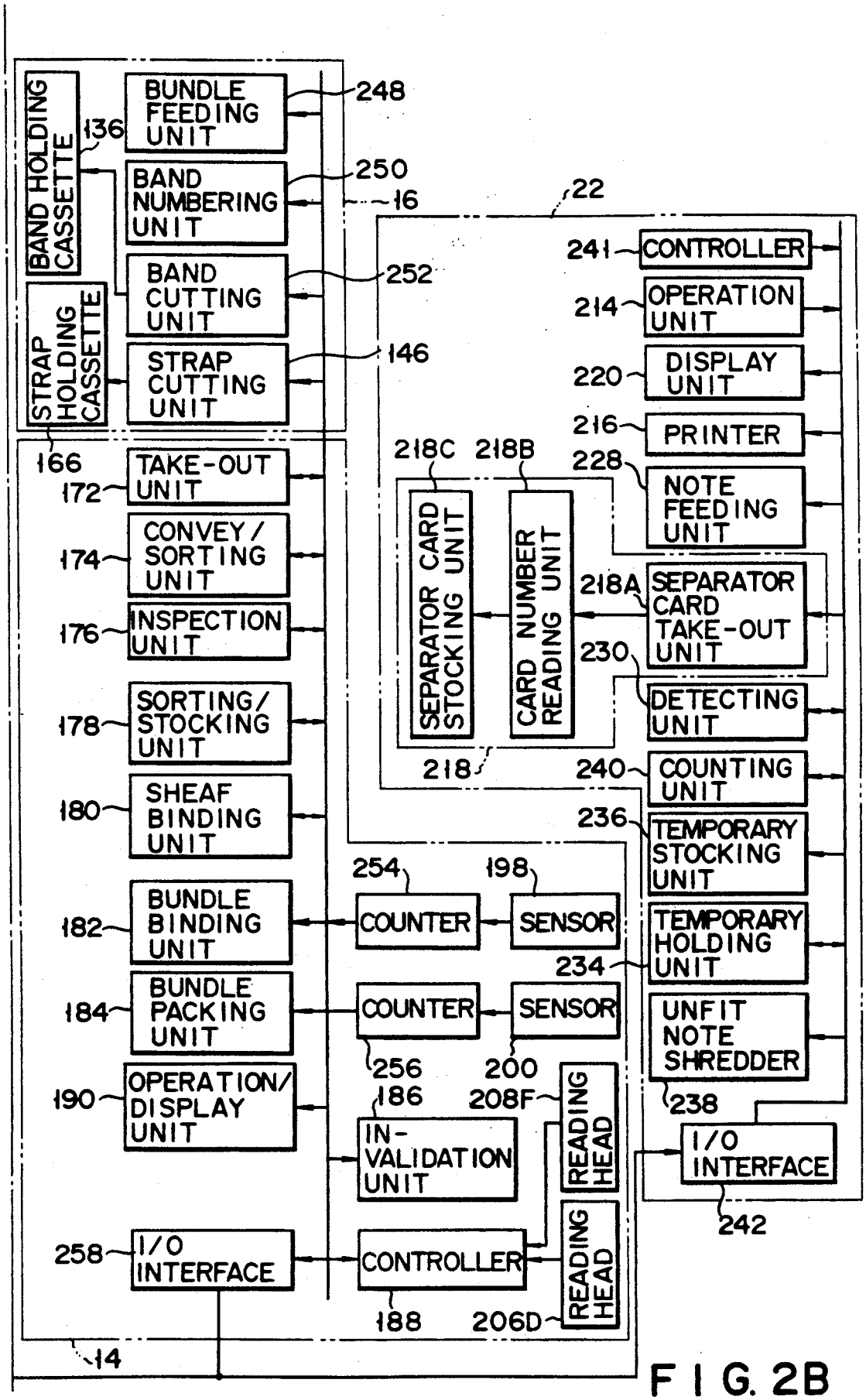
Figure 3:
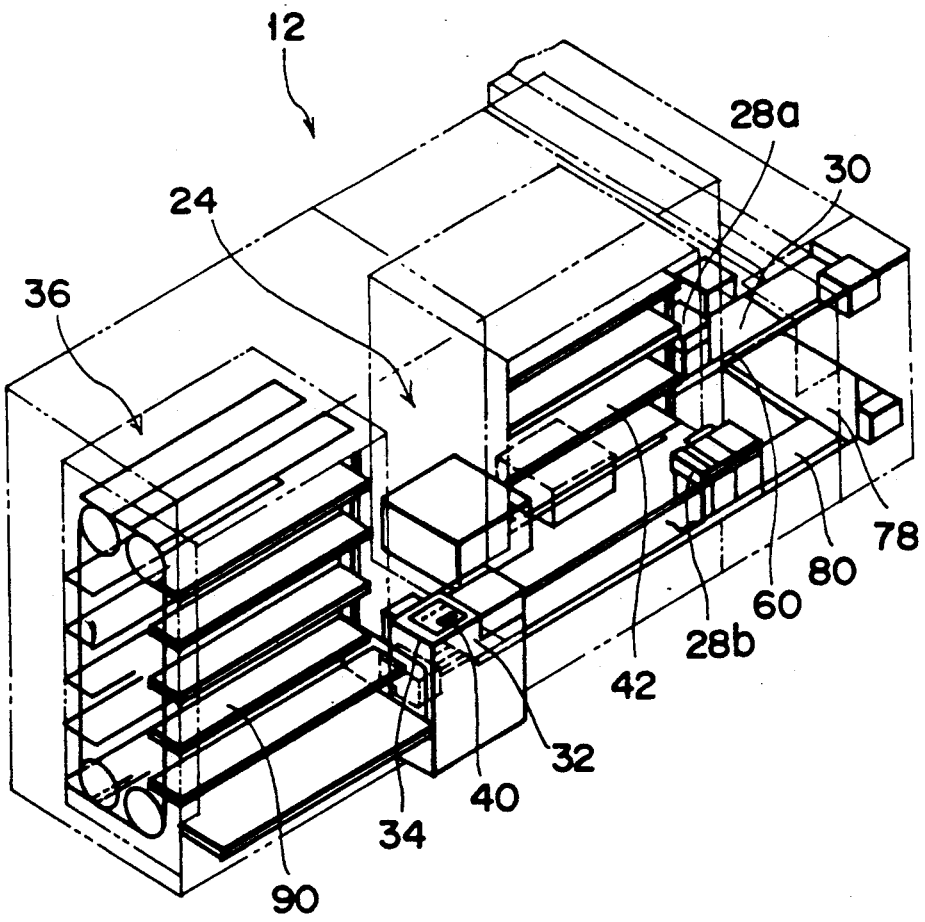
FIG. 3 is a perspective view for explaining an arrangement of a bundle processor.

Bundle processor 12 comprises uninspected bundle inserting base 24 as an inserting base of an uninspected bundle, bundle take-out unit 26, 10-sheaf counting units **28*a* and 28*b*, inserted bundle rejecting unit 30, received bundle rejecting unit 32, stamping/stocking unit 34, inspected bundle receiving base 36 as an inspected bundle collecting unit, denomination checking units 38A and 38B, operation display panel 40, and the like, as shown in FIGS. 2A, 2B and 3**.

Figure 4:
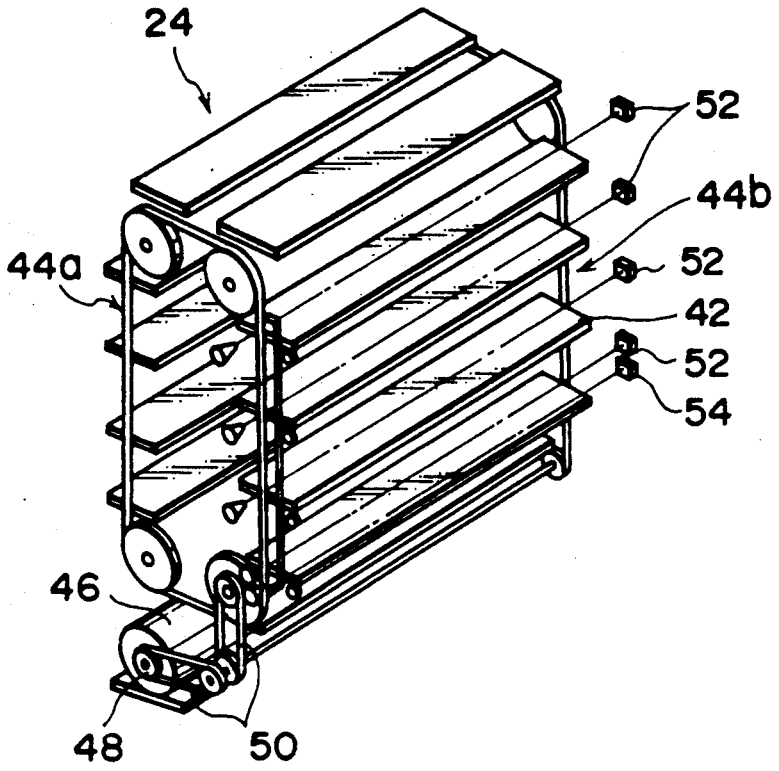
FIG. 4 is a view for explaining a schematic arrangement of an uninspected bundle inserting base.

Uninspected bundle inserting base 24 is constituted as shown in FIG. 4.

Figure 5:
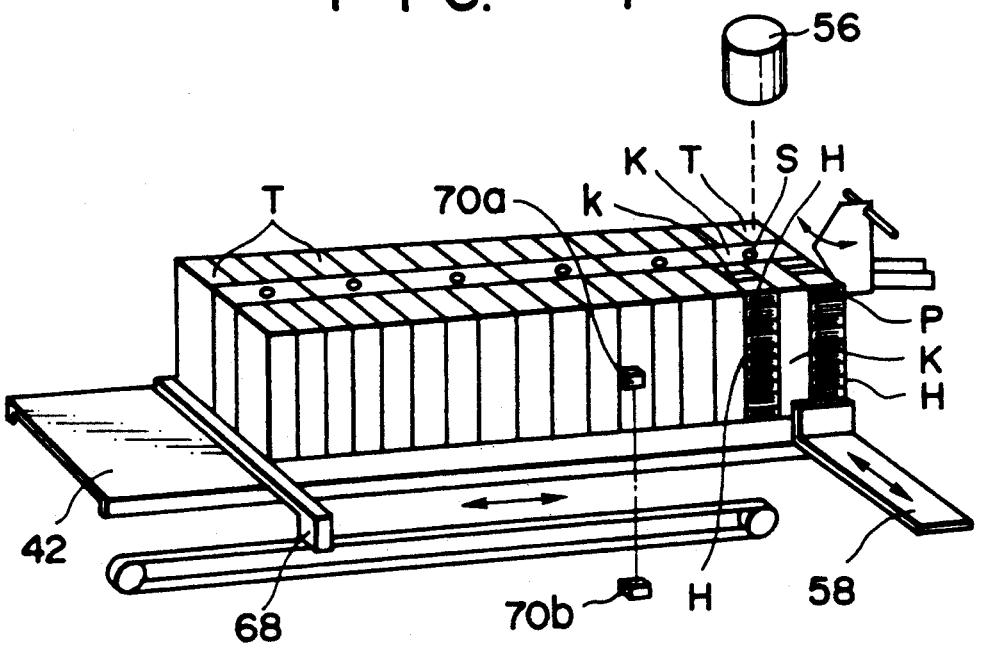
FIG. 5 is a view for explaining a processing state of a bundle on a shelf constituting the uninspected bundle inserting base.

More specifically, bundles T inserted by an operator are placed on shelves 42 as placing units A maximum of 10 bundles T can be inserted on each shelf 42. As shown in FIG. 5, bundle T is prepared such that, e.g., 100 bank notes (to be referred to simply as notes hereinafter) P as paper sheets are stacked and are bound by strap k to obtain sheaf H, and 10 sheaves H are cross-bound by bands K. Bundle T is placed on shelf 42 so that branch name seal S of a bank printed on band K faces up, and strap k faces the front side.

The two end portions of each shelf 42 are coupled to endless chains **44*a* and 44*b*, which can be circulated by motor 46 through- pulleys 48 and belts 50**.

Four shelves 42 are designed to be always present on the operation side, so that a maximum of 40 bundles T can be stacked. Sensor 52 for detecting the presence/absence of bundle T is horizontally disposed at a position corresponding to each stage of shelves 42. In accordance with each detection output, automatic rotation of shelves 42, and automatic stop and alarm when no bundle T is stacked can be controlled. More specifically, when given sensor 52 detects that lowermost shelf 42 is empty, shelves 42 are automatically moved downward by one stage.

Monitor sensor 54 and sensor 56 for obtaining confirmation data of a denomination are provided at a position corresponding to lowermost shelf 42 in addition to sensor 52. When monitor sensor 54 is shielded during rotation of shelves 42, shelves 42 are immediately stopped, thus guaranteeing safety of an operator. The confirmation data obtained by sensor 56 is sent to center console 20 (to be described later).

Figure 6:
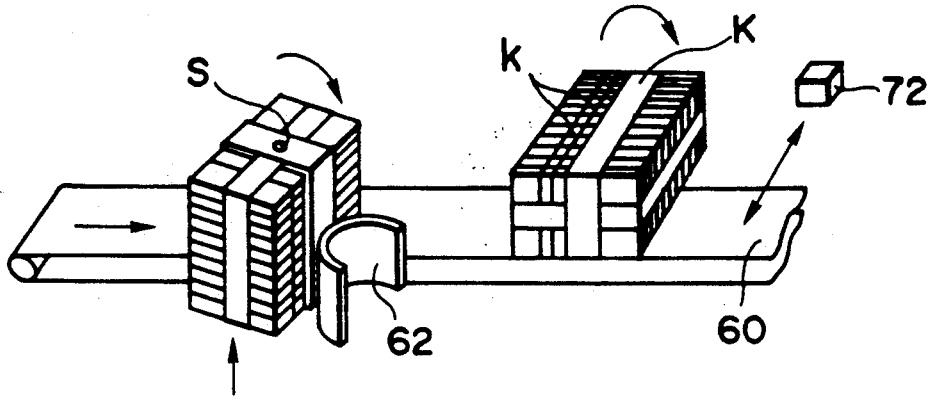
FIG. 6 is a view for explaining a state wherein a bundle is conveyed by a bundle conveyor.

Bundle T is taken out on the right side (FIG. 5) of lowermost shelf 42. More specifically, when bundle T to be taken out has reached the right end of shelf 42, it is pushed out by bundle push-out arm 58 onto bundle conveyor 60 (FIG. 6) disposed parallel to and behind shelf 42. In this process, the leading end of bundle T contacting bundle conveyor 60 begins to move to the right, and right movement of the trailing end of bundle T is temporarily regulated by arcuated guide plate 62, as shown in FIG. 6. Thus, bundle T is rotated and finally turned through 90°. The upper end of bundle T is pushed backward by an aligning machine (not shown), and bundle T is caused to fall down. In this manner, bundle T passes through 10-sheaf counting unit 28*a*, so that bundle T consisting of more than or less than 10 sheaves is transferred to rejectable bundle stocking box 64 (to be described later), and bundle T consisting of 10 sheaves is transferred to inserted bundle conveyor 66 (to be described later).

Rightmost bundle T on shelf 42 shown in FIG. 5 is pushed out backward by bundle push-out arm 58. After arm 58 is returned to the initial position, movement of bundle transfer arm 68 is stopped in accordance with signals from sensors 70*a* and 70*b* for detecting that bundle transfer arm 68 is moved to the right.

10-sheaf counting unit 28*a* will be described below.

10-sheaf counting unit 28*a* is arranged in a bundle convey path direction of bundle conveyor 60, and irradiates conveying bundle T shown in FIG. 6 with light from scanner 72 to scan it in a direction perpendicular to the convey direction. Counting unit 28*a* detects a boundary of straps k by utilizing an amount of reflected light, and counts the detected boundaries, thereby detecting the number of sheaves.

Figure 7:
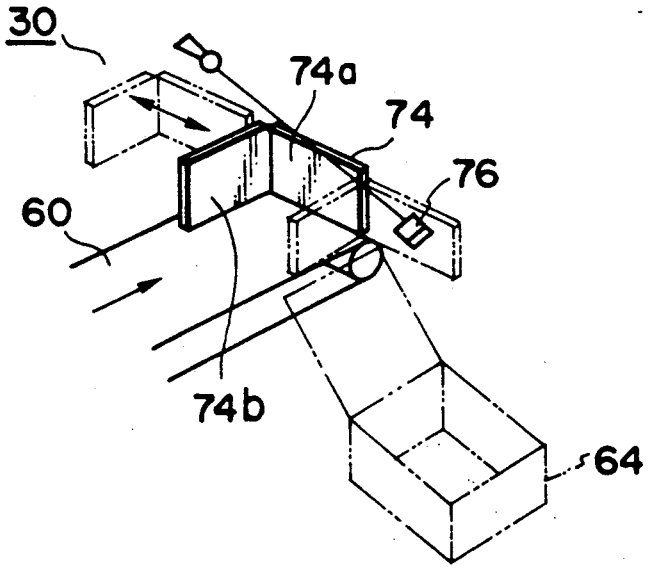
FIG. 7 is a view for explaining a state wherein bundles conveyed by the bundle conveyor are distributed by a bundle stop/rejecting arm.

Inserted bundle rejecting unit 30 has bundle stop/-rejecting arm 74 and rejectable bundle stocking box 64, as shown in FIG. 7, and is driven in accordance with a signal from 10-sheaf counting unit 28*a*. More specifically, bundle stop/rejecting arm 74 is pushed out onto bundle conveyor 60 in response to an abnormality signal issued for bundle T for which 10-sheaf counting unit 28*a* detects abnormality, i.e., cannot detect 10 sheaves before the bundle reaches a rejecting position. Thus, conveyed bundle T is stopped by front surface 74*a* of bundle stop/rejecting arm 74, and is pushed and dropped by its side surface 74*b* into rejectable bundle stocking box 64 arranged on one side of bundle conveyor 60.

The output from bundle arrival detector 76 shown in FIG. 7 is used as an operation trigger when bundle T is pushed and dropped by side surface 74*b* of arm 74.

For bundle T for which 10-sheaf counting unit 28*a* detects 10 sheaves, arm 74 is not operated. Thus, bundle T passes through inserted bundle rejecting unit 30, and is delivered to inserted bundle conveyor 78 (to be described later).

Received bundle rejecting unit 32 has substantially the same arrangement as that of inserted bundle rejecting unit 30 except that the convey direction of bundle conveyor 80 on the reception side (to be described later) is opposite to that of bundle conveyor 60 shown in FIG. 7, and a detailed description thereof will be omitted.

Figure 8:
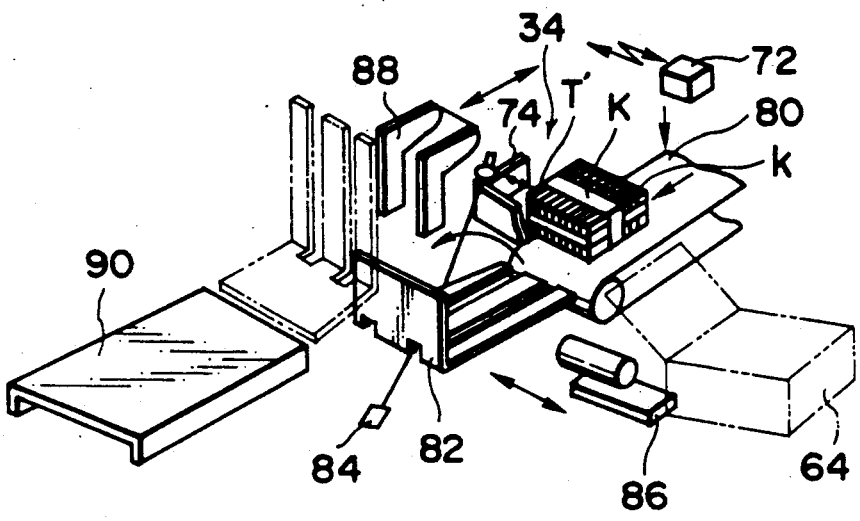
FIG. 8 is a view for explaining a state wherein a bundle is conveyed from the bundle conveyor to a shelf constituting an inspected bundle inserting base.

Stamping/stocking unit 34 is located at the end of bundle conveyor 80 on the reception side, as shown in FIG. 8, and receives, at rotary table 82, inspected bundle T′ (to be described later) conveyed along bundle conveyor 80.

More specifically, bundle arrival detector 84 detects bundle T′, and rotary table 82 is rotated through 90° in accordance with detection of detector 84, thereby turning bundle T′ through 90°. From this state, a bank name seal is stamped by stamping device 86 on a crossing portion of bands K.

After the seal is stamped, bundle T′ on rotary table 82 is pushed out by stocking arm 88 onto shelf 90 of inspected bundle receiving base 36.

After the push-out operation, rotary table 82 and arm 88 are returned to their initial positions to prepare for next bundle T′ to be processed.

Inspected bundle receiving base 36 has five stages of shelves 90 which have the same arrangement as that of uninspected bundle inserting base 24 and can be circulated so as to stock stamped inspected bundles T′.

Figure 9:
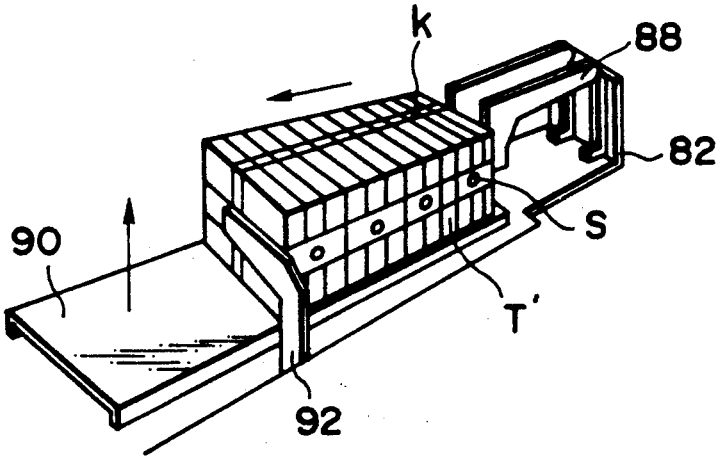
FIG. 9 is a view for explaining a state wherein inspected bundle inserting base.

As shown in FIG. 9, when bundles T′ are stacked on shelf 90 while branch name seals S face forward, these bundles T′ are pushed in by stocking arm 88 from the right end of lowermost shelf 90 to another shelf 90. Holding arm 92 is arranged on the left side of pushed bundles T′. Arm 92 is moved by a predetermined amount each time one bundle is pushed in, thus preventing bundles T′ from falling down.

Note that the operation principle of holding arm 92 is the same as that of bundle transfer arm 68 of uninspected bundle inserting base 2 although their moving directions differ.

The processing operation of bundles T′ on shelf 90 will be briefly described below.

When bundles T′ are stacked on shelf 90, shelf 90 is moved upward by one stage by the circulating operation, and restarts receiving of next bundle T′.

Each time bundle T′ is stacked, shelf 90 is moved upward by one stage. Not only when bundles T′ are stacked on all the five stages, but also when bundles T′ are stacked on the uppermost stage regardless of lower stages, the apparatus is stopped, and a buzzer is turned on to cause an operator to take bundle T′ into shelf 90 (especially, uppermost stage).

Figure 10:
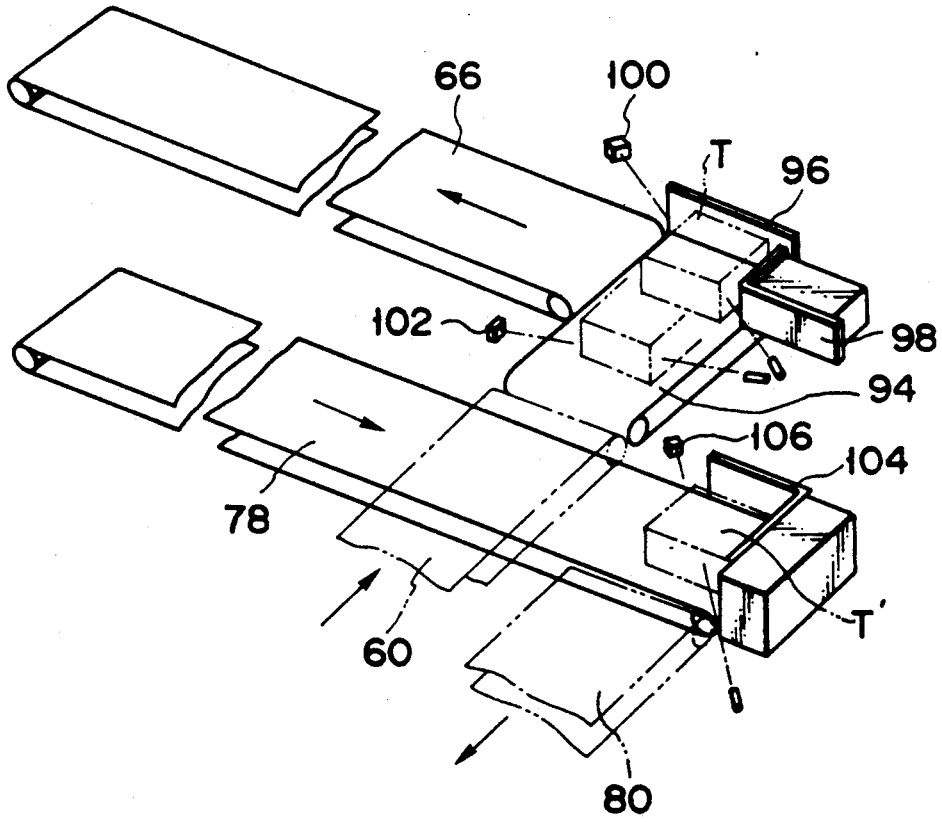
FIG. 10 is a view for explaining a convey state of an uninspected bundle from the bundle conveyor to an inserted bundle conveyor and a convey state of an inspected bundle from a received bundle conveyor to the bundle conveyor.

Conveyor 18 will be described hereinafter with reference to FIGS. 9 and 10.

Bundle T conveyed by bundle conveyor 60 of bundle processor 12 is received on buffer conveyor 94, and is stopped by bundle stop wall 96. Buffer conveyor 94 is designed so that two bundles T can be stored thereon. In this case, second bundle T abuts against the trailing end of first bundle T and is stopped. In this embodiment, the number of stored bundles is 2, but is not limited to 2 and can be an arbitrary value.

Inserted bundle push plate 98 is operated in response to a control signal from center console 20, and pushes out bundle T one by one onto inserted bundle conveyor 66. In this case, during the push operation of the first bundle, second bundle T is regulated by the side wall of inserted bundle push plate 98. When inserted bundle push plate 98 is returned to its initial position, the second bundle is moved toward bundle stop wall 96, and is stopped thereby. Thus, inserted bundle push plate 98 prepares for the next operation. Bundle push arm 58 of bundle processor 12 is operated in accordance with a detection signal from bundle detector 100 or 102, thereby inserting next bundle T. In inserted bundle conveyor 66, a bundle plunger (to be described later) enters inserted bundle conveyor 66 from the side of pre-processor 16, thereby receiving bundle T into pre-processor 16.

In this embodiment, a detector is arranged in front of the end of inserted bundle conveyor 66. When it is determined in accordance with a signal from the detector that the bundle plunger fails to take bundle T on inserted bundle conveyor 66, bundle T is stocked in a rejecting box as a storing box (not shown) provided at the end of inserted bundle conveyor 66. Therefore, even if pre-processor 16 at the end fails to fetch bundle T, bundle T does not remain on a receiving portion of pre-processor 16, and the operation of pre-processor 16 will not be disturbed.

Inspected bundle T' rejected from inspection device 14 (to be described in detail later) is transferred onto received bundle conveyor 78 and is conveyed thereby. Received bundle push plate 104 is arranged at the convey end of received bundle conveyor 78 so as to receive conveyed bundle T'. Bundle T' is then transferred onto bundle conveyor 80 of bundle processor 12 in accordance with a signal from detector 106.

Figure 11:
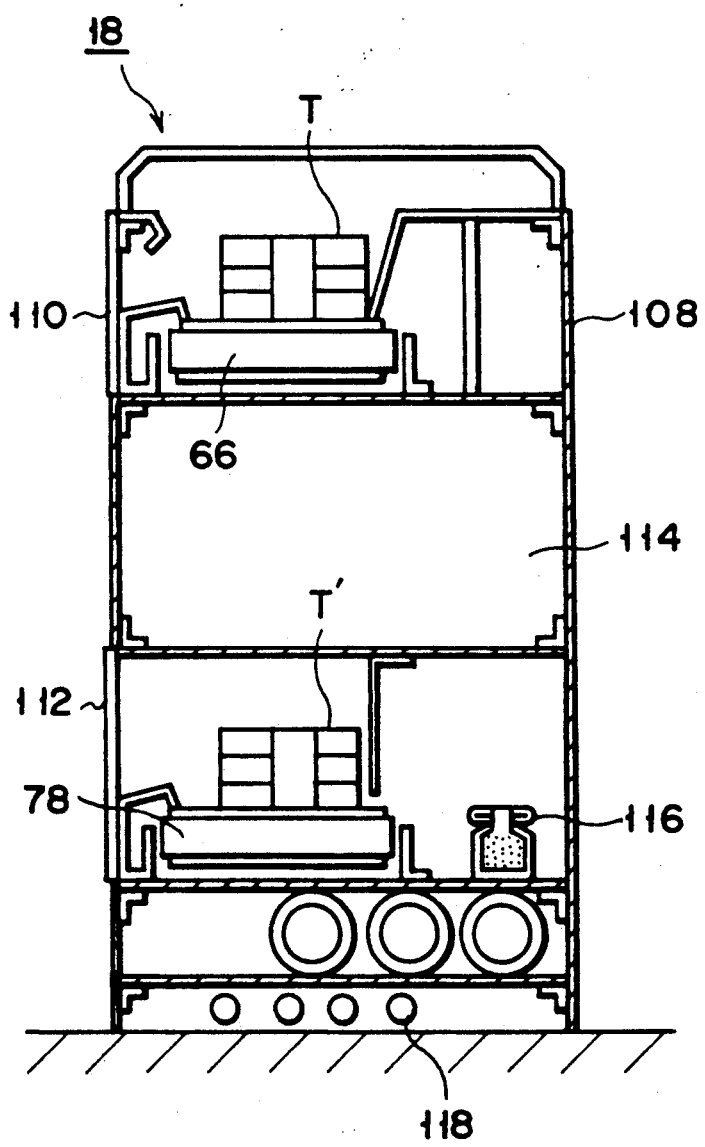
FIG. 11 is a schematic sectional view of the conveyor.

Inserted bundle conveyor 66 and received bundle conveyor 78 constituting conveyor 18 are arranged as shown in FIG. 11. These conveyors 66 and 78 are arranged in housing 108, and covers 110 and 112 which can deliver/receive bundles T and T' as needed are arranged on one side surface of housing 108. In housing 108, exhaust duct 114 for collecting heat dissipated from bundle processor 12 and inspection device 14 is arranged, and signal cable 116 and power cable 118 are also disposed.

A processing state of a bundle of paper sheets in pre-processor 16 will be described hereinafter with reference to the schematic view of FIG. 12.

When bundle T conveyed on inserted bundle conveyor 66 is detected by a sensor (not shown) near an insertion port of pre-processor 16, shutter 120 is opened. In this case, bundle T is conveyed to a predetermined take-in position (A) by inserted bundle conveyor 66. Bundle plunger 122 is driven at the take-in position (A) to take bundle T inside the processor. Bundle T is then conveyed to a position (B) at which bundle T abuts against a vertically movable side stopper (not shown). In this case, a serial number indicating the relationship with paper sheets is stamped on band K binding bundle T conveyed to the side stopper.

In this state, the above-mentioned side stopper is moved downward, and the abutting state of bundle T is released. Thus, bundle plunger 122 is driven again, and bundle T is conveyed to a first cutting position (C). As soon as bundle T is conveyed to the position (C), bundle moving device 126 is operated, and moves bundle T toward vertically movable bundle stopper 128. Bundle moving device 126 and bundle stopper 128 clamp bundle T therebetween to position it. At the same time, two bands K binding bundle T are cut by two cutters 130A and 130B constituting first cutting unit 130, thus unbinding bundle T. Subsequently, bands K are separated from the sheaves by two catches 132A and 132B constituting first band separating unit 132. Bands K are conveyed downward by push plate 134, and stored in band holding cassette 136.

10 sheaves from which bands K are removed wait at the position (C) until separation of each of 10 sheaves of previously conveyed bundle T is completed. After the separation of the last sheaf of previously conveyed bundle T is completed, sheaf moving unit 138 is moved to and stopped at the first cutting position (C), i.e. the position of bundle stopper 128. Bundle stopper 12 is then moved upward to release a clamping state of the unbound 10 sheaves with bundle moving device 126. In this case, the sheaves are clamped between bundle moving device 126 and sheaf moving unit 138. These unbound 10 sheaves are conveyed to a sheaf separating position (D) while being clamped.

When sheaf moving unit 138 is moved to the sheaf separating position (D), it is moved downward, passes below the sheaves, is returned to a position nearer the first cutting position (C) than bundle moving device 126, and is then moved upward. Thereafter, unit 138 is moved toward sheaf separating position (D) again to press the sheaves. Bundle moving device 126 is returned to the first cutting position (C) to wait for processing of the next bundle. The 10 sheaves conveyed to the sheaf separating position (D) are separated from each other by separating member 142 while being held by sheaf moving unit 138 and sheaf stopper 140, and are then conveyed one by one to a second cutting position (E). At the second cutting position (E), strap cutting unit 146 for cutting strap k binding each sheaf is arranged.

Strap cutting unit 146 comprises sheaf compression mechanism 148, second cutting unit 150, pusher 152, strap turn-over unit 154, catch 156, strap printer 158, and band convey belt 160. Sheaf compression mechanism 148 moves a sheaf upward to clamp it with a fixed surface of a ceiling base (not shown), thereby positioning and holding the sheaf. Second cutting unit 150 cuts strap k of the sheaf held by sheaf compression mechanism 148 using two cutters 150A and 150B. Pusher 152 conveys unbound paper sheets T and strap k to an extraction position (F) (to be described later) of strap k while sheaf compression mechanism 148 is located at a lower position. Strap turn-over unit 154 is in contact with the lower surface side of paper sheets T conveyed by pusher 152 through friction member 162. Catch 156 constitutes second band separating unit 164 which extracts strap k turned over by strap turn-over unit 154 from the paper sheets to separate the paper sheets from the strap. Strap printer 158 stamps a serial number indicating the relationship with paper sheets on strap k extracted by catch 156. Band convey belt 160 receives strap k extracted by catch 156. Strap k is conveyed by band convey belt 160 to the insertion port of strap holding cassette 166, and is sequentially stored therein by band storing member 168. 100 notes T1 from which strap k is removed are fed to inspection device 14 by a feeding unit (not shown).

Figure 12:
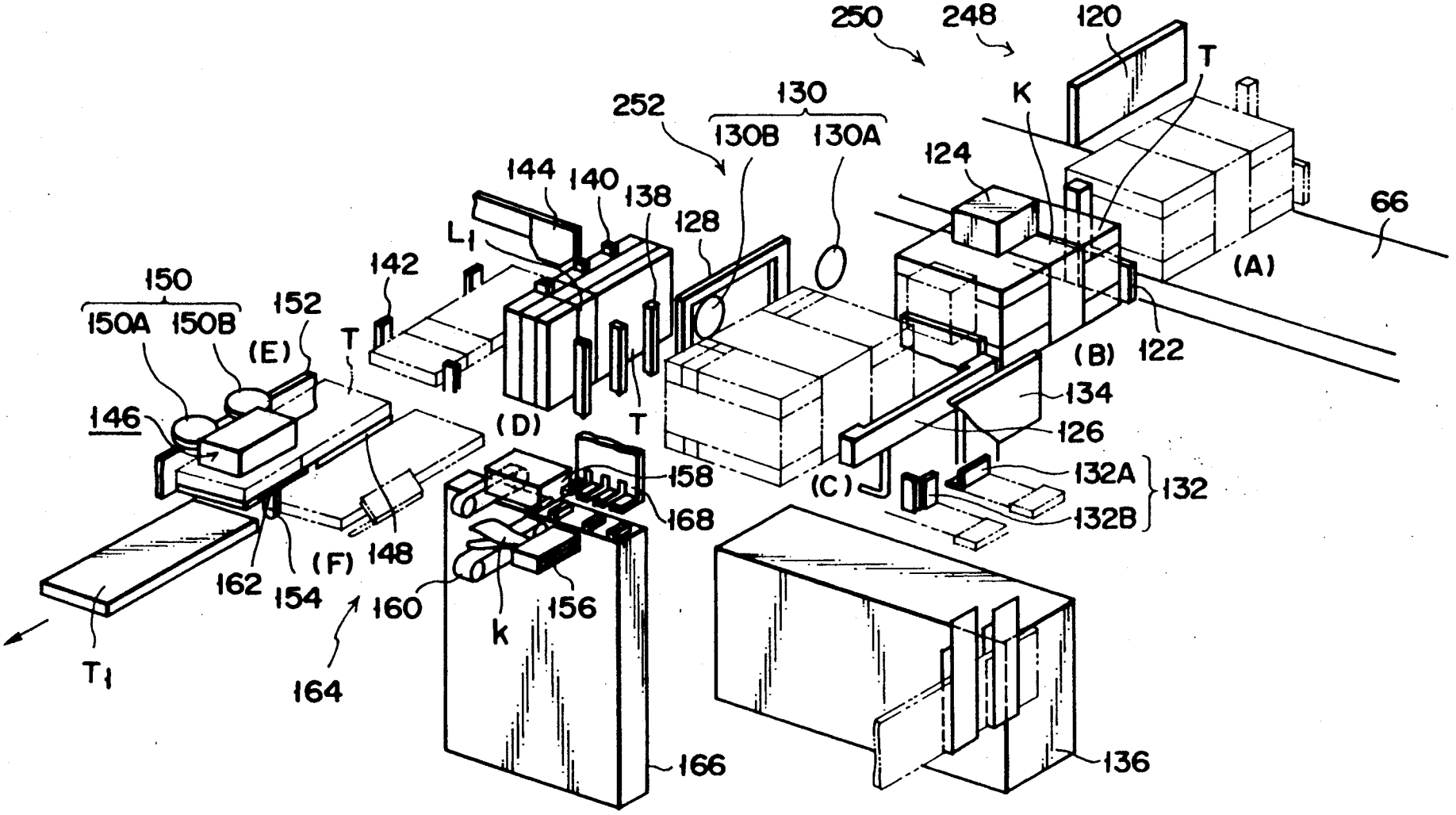
FIG. 12 is a view showing a schematic arrangement of a pre-processor.

Note that strap cutting unit 146 for cutting strap k of a sheaf which is conveyed one by one to the second cutting position (E) by sheaf feeding member 144 moves the sheaf upward to the fixed surface of the ceiling base of the apparatus body upon upward movement of sheaf compression mechanism 148 to clamp it, thereby positioning and holding the sheaf, as shown in FIG. 12. Thus, a curved sheaf or the like can be flattened, and strap k can be easily cut.

Figure 13A:
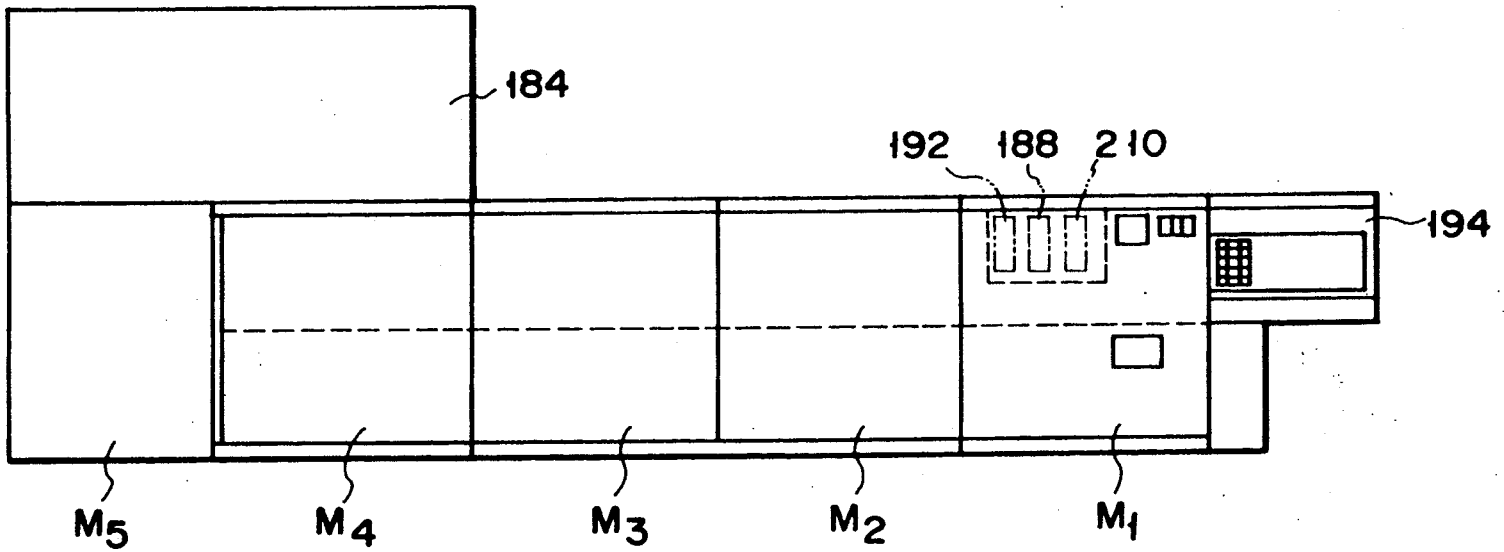
Figures 13B, 13C:
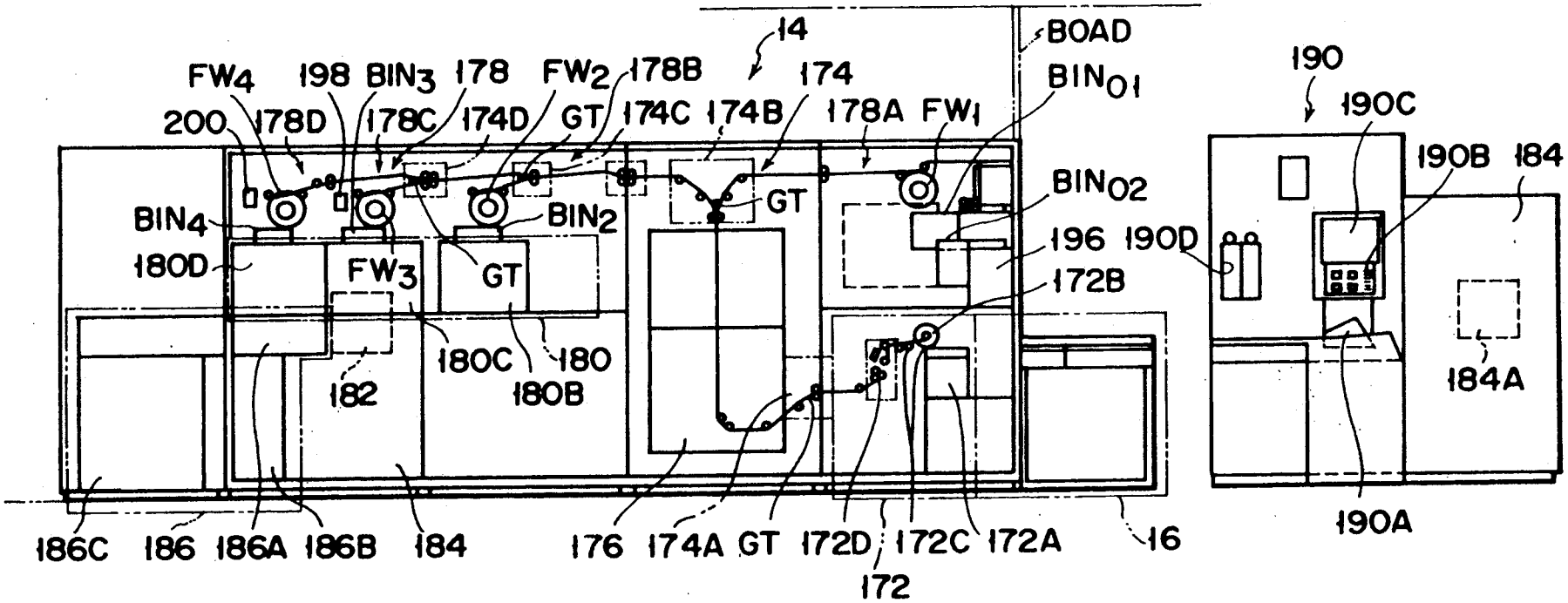

Inspection device 14 will be described below with reference to FIGS. 13A to 13C.

Inspection device 14 is connected to pre-processor 16 for sending, to device 14, notes T1 from which the strap is removed.

Inspection device 14 comprises take-out unit 172, convey/sorting unit 174, inspection unit 176, sorting/-stocking unit 178, sheaf binding unit 180, bundle binding unit 182, bundle packing unit 184, invalidation unit 186, control unit 188, and operation display unit 190.

Note that operation display unit 190 is an example of an operation unit, and take-out unit 172, convey/sorting unit 174, inspection unit 176, sorting/stocking unit 178, sheaf binding unit 180, bundle binding unit 182, bundle packing unit 184, and invalidation unit 186 are an example of a mechanism unit. In order to prevent transmission of noise from the mechanism unit to the operation unit, wall BOAD extending from the floor to the ceiling of a space where the apparatus is installed is arranged around operation display unit 190, so that the operation unit and the mechanism unit are substantially partitioned by this wall BOAD. In this embodiment, a "sheaf" is obtained by stacking and binding 100 paper sheets (e.g., securities such as bank notes, to be referred to as notes hereinafter). A "bundle" is one obtained by binding 10 sheaves. "Fit or correct notes" are notes which are determined as a result of inspection to be normal and valid, and are returned for reuse from an issuer. "Unfit notes" are notes which are determined as a result of inspection to be normal an valid but are discarded by the issuer since they are unsuitable for reuse. "Counterfeit notes" are notes which are determined as a result of inspection to be abnormal and invalid (notes which cannot be judged are determined to be invalid). "Unmachinable notes" are notes which cannot be inspected due to overlapping, skew (of notes), short pitch (in a convey path, an interval from the immediately preceding note is too short, and subsequent processing cannot be performed), and the like. Of these notes, since the "counterfeit notes" and "unmachinable notes" are rejected from the apparatus, they are also called "rejectable notes".

Sorting/stocking unit 178 is divided into rejectable note sorting/stocking unit 178A, different denomination note sorting/stocking unit 178B, fit or correct note sorting/stocking unit 178C, and unfit note sorting/stocking unit 178D. Four convey/sorting units 174 (174A to 174D) are arranged in accordance with the divided units. Each convey/sorting unit 174 has gate GT. Sorting/stocking units 178A to 178D respectively have known recovery wheels FW1 to FW4 which can fetch notes one by one and stock them in corresponding stocking boxes BIN. Of these stocking boxes, upper and lower stocking boxes BIN01 (counterfeit note stocking box) and BIN02 (unmachinable note stocking box) are provided in rejectable note sorting/stocking unit 178A. Stocking boxes BIN2 to BIN4 are respectively arranged in other sorting/stocking units 178B to 178D. Sheaf binding unit 180 is also divided into sheaf binding units 180B, 180C, and 180D and arranged below corresponding stocking boxes BIN2 to BIN4. Bundle binding unit 182 is arranged below sheaf binding unit 18 arranged below fit note stocking unit 178C, and has a window for transferring notes to subsequent bundle packing unit 184. Take-out unit 172 is constituted by stocking unit 172A for stocking notes T1 sent from pre-processor 16, delivery roller 172B for picking up notes one by one from stocking unit 172A, convey rollers 172C for conveying picked-up notes, and examination unit 172D, arranged along the convey path, for examining a feature of notes (unmachinable state such as overlapping, skew, short pitch, or the like). Note that examination unit 172D and inspection unit 176 are examples of examination devices for examining notes in accordance with predetermined items, and their examination results are stored in memory unit 192 of control unit 188. Take-out unit 172 does not take out notes from the next sheaf until the processing of the immediately preceding sheaf is completed. Operation display unit 190 is constituted by entrance portion 190A for a fed sheaf, operation unit 190B arranged above portion 190A and including a ten-key pad, and the like, and cassette take-out port 190D, as shown in FIG. 13C. Note that bundle packing unit 184 has take-out port 184A. Portions housing the above-mentioned units are moduled, and as shown in FIG. 13A, feeding module M1 to which feeding base 194 is detachably mounted, inspection module M2, stocking modules M3 and M4, discard module M5, and bundle packing unit 184 are detachably arranged and can be easily added or omitted as needed in accordance with applications and required functions. As shown in FIG. 13B, feeding module M1 houses rejectable note sorting/stocking unit 178A and take-out unit 172, and control unit 188 is housed therebehind. Module M2 houses inspection unit 176 and first and second convey/sorting units 174A and 174B. Module M3 houses different denomination note sorting/stocking unit 178B, sheaf binding unit 180, and third convey/sorting unit 174C. Module M4 houses fit note sorting/stocking unit 178C and its binding unit 180C, unfit note sorting/stocking unit 178D and its binding unit 180D, sensors 198 and 200 for respectively detecting fit and unfit notes so as to count them, fourth convey/sorting unit 174D, and shredders 186A and 186B as first and second invalidation units. Module M5 houses discard box 186C.

Rejectable note cassette 196 is arranged near two stocking boxes BIN01 and BIN02.

Figure 14:
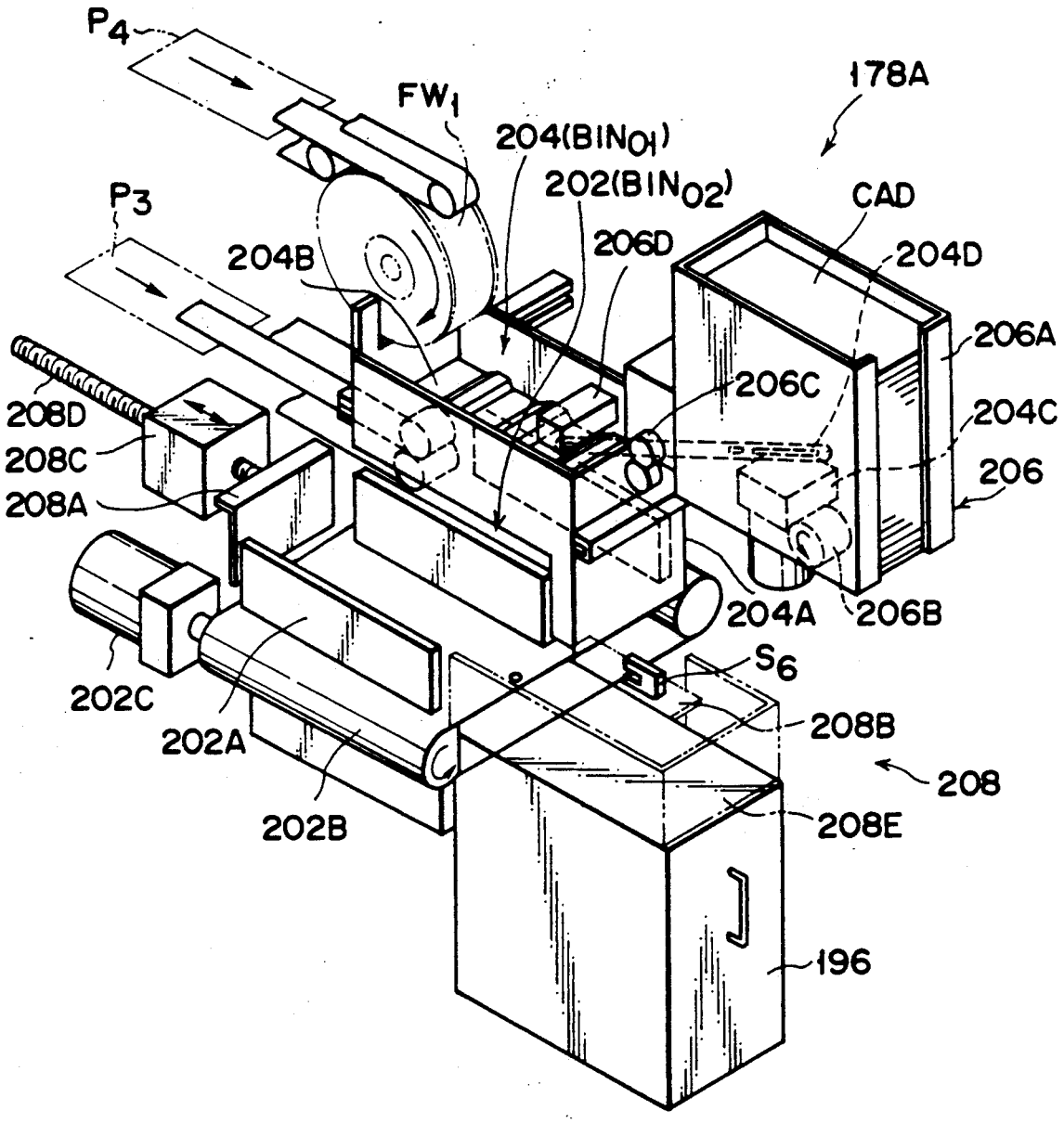
FIG. 14 is a perspective view showing a schematic arrangement of a rejectable note sorting/stocking unit.

Rejectable note sorting/stocking unit 178A is constituted by unmachinable note stocking unit 202 (BIN02), counterfeit note stocking unit 204 (BIN01), separator card issuer 206, and cassette stocking unit (as an example of a rejectable note stocking device for stocking notes to be rejected based on an inspection result) 208, as shown in FIG. 14. Unmachinable note stocking unit 202 sequentially stacks and stocks unmachinable notes P3 from below. Unit 202 has conveyor belt 202B provided with a plurality of upright sorting plates 202A which can be moved in a horizontal direction perpendicular to the note entrance direction, and motor 202C for driving the conveyor belt. Conveyor belt 202B is driven in accordance with detection results from a sensor (not shown) for detecting movement of conveyor belt 202B and positioning sensor S6 for detecting holes formed in a side edge portion of the conveyor belt at equal intervals, so that notes stacked on conveyor belt 202B are moved to a predetermined position. Upright sorting plates 202A mounted on conveyor belt 202B are arranged at equal intervals, and two upright sorting plates 202A form two walls of the stocking box in a direction perpendicular to the note entrance direction. Conveyor belt 202B is moved at a predetermined pitch, and after movement of belt 202B, two walls of the stocking box are formed by other upright sorting plates. Counterfeit note stocking unit 204 temporarily receives counterfeit notes sent by a convey device by a curved groove of recovery wheel FW1 which is rotated at a low speed in the same direction as the note moving direction to decelerate notes, and then stacks and stocks the notes from below. In stocking unit 204, the curved groove of recovery wheel FW1 is rotated synchronously with notes which move toward recovery wheel FW1 in the same manner as in the fit and unfit note stocking units, so that notes can reliably enter the curved groove of recovery wheel FW1. A note entering the curved groove of recovery wheel FW1 is rotated through about 180°, and movement of the note is disturbed by fixed plate 204A provided in the note leading end direction. Upon rotation of recovery wheel FW1, the note is gradually drawn out from the curved groove, and is uniformly stocked in stocking unit 204.

Bottom plate 204B of stocking unit 204 is movable in a horizontal direction. When motor 204C is rotated, bottom plate 204B is moved outside stocking unit 204 through arm 204D, and stocked notes can be discharged downward from stocking unit 204. Unmachinable note stocking unit 202 is located below stocking unit 204. Counterfeit notes stocked in stocking unit 204 can be stacked on unmachinable notes stocked in stocking unit 202.

Separator card issuer 206 issues a separator card after a rejectable note stocking operation of a sheaf of notes is completed, thereby sorting notes stocked in a rejectable note stocking unit (rejectable note cassette 196) into sheaves of notes. For example, separator cards CAD horizontally stacked in card box 206A are exhausted outside the box one by one. Inherent numbers are provided to separator cards CAD. When take-out roller 206B arranged under the lower surface of lowermost separator card CAD is rotated once, the leading end of card CAD reaches exhaust roller 206C and the card is exhausted upon rotation of roller 206C. In the exhaust process of separator cards CAD, the inherent number on each separator card is read by reading head 206D, and is stored in memory unit 192 of control unit 188. Exhausted separator card CAD is stocked in counterfeit note stocking unit 204.

Cassette stocking unit 208 stocks notes or the like stacked on conveyor belt 202B of stocking unit 202 into cassette 196. Stocking unit 208 comprises push plate 208A for pushing out notes or the like on conveyor belt 202B into cassette 196, push plate 208B for pushing notes on the cassette therein from above, and cassette 196. Upon rotation of motor 208C, ball screw shaft 208D is moved forward/backward, and push plate 208A fixed to the distal end of the shaft is moved forward/backward together with shaft 208D, thereby pushing out notes or the like. The pushed notes are aligned by plate 208E arranged on the cassette. Push plate 208B stands by at a position above cassette 196, and is moved downward to push notes into cassette 196. Cassette 196 is a casing having an upper opening, and comprises a backup plate (not shown) for locking at an arbitrary position by a frictional force. The backup plate is pressed and moved downward by the push plate through the stocked notes or the like. When the backup plate is located at a lowermost position, this state is detected by a sensor (not shown) through a notch formed in cassette 196, and a full signal is generated.

Note that cassette 196 has a cassette number (e.g., bar code) for identifying the cassette. This cassette number is read by reading head 208F.

The inherent number of each separator card CAD is stored in memory unit 192 of control unit 188 in correspondence with the examination result of notes stocked in the rejectable note stocking unit (rejectable note cassette 196). When a desired number of sheaves of notes is completely processed by the apparatus of this embodiment, the separator card is taken out from cassette 196 from one issued first or lastly (in the apparatus of this embodiment, the separator card issued lastly), and its inherent number is input at operation display unit 190, so that examination result data corresponding to the input inherent number is displayed on monitor CRT 190C (as an example of display means for displaying at least examination result data stored in memory means). In addition, control unit 188 is provided with controller 212 which performs a control operation, so that examination data corresponding to an inherent number following this inherent number (inherent number of a second lowermost separator card) is sequentially and automatically displayed on monitor CRT 190C.

An operation of rejectable note sorting/stocking unit 178A will be described below. Notes are taken out one by one by take-out unit 172. Assume that one counterfeit note and one unmachinable note are stocked in separate stocking boxes. When a detection result of a 100th note is generated or when the trailing end of the 100th note shields the sensor (not shown) at the entrance of the counterfeit note stocking box, separator card take-out roller 206B begins to rotate and separator card CAD is exhausted onto the counterfeit note. Thereafter, motor 204C for driving bottom plate 204B of counterfeit note stocking box 204 is rotated, so that bottom plate 204B is moved outside the stocking box through arm 204D. Thus, the counterfeit note and the separator card are sequentially stocked on the unmachinable note. Then, belt conveyor motor 202C of unmachinable note stocking unit 202 is rotated, and conveyor belt 202B begins to move. When a plurality of upright sorting plates 202A are moved by one pitch, the holes of the belt are detected by sensor S6, and the rotation of motor 202C and movement of conveyor belt 202B are stopped. At the same time, push plate motor 208C begins to rotate, and unmachinable note P3, counterfeit note P4, and separator card CAD on conveyor belt 202B are pushed out onto cassette 196 by push plate 208A. When push plate 208A is moved to its frontmost position, it is detected by the sensor (not shown), and the push plate motor (not shown) begins to rotate in response to the detection signal from the sensor. At the same time, push plate motor 208C is rotated in the reverse direction to return push plate 208A to its original position. Thereafter, motor 208C is stopped. Push plate 208A is returned to the original position and is stopped when it is moved by a predetermined stroke. The above-mentioned operation corresponds to one cycle, and is repeated sequentially. Rejectable notes (counterfeit and unmachinable notes) of each sheaf of notes are stocked in cassette 196 while being partitioned by separator card CAD. Thus, the number of rejected notes need not be confirmed each time processing of one sheaf of notes is completed. Therefore, after processing of all the sheaves of notes is completed, the number of rejected notes partitioned by the separator cards need only be checked. If neither unmachinable nor counterfeit notes are present in one batch, no separator card CAD is issued and stocked in cassette 196. If separator card CAD directly enters cassette 196 first or lastly, the same effect of the separator card as described above can be obtained.

Figure 15:
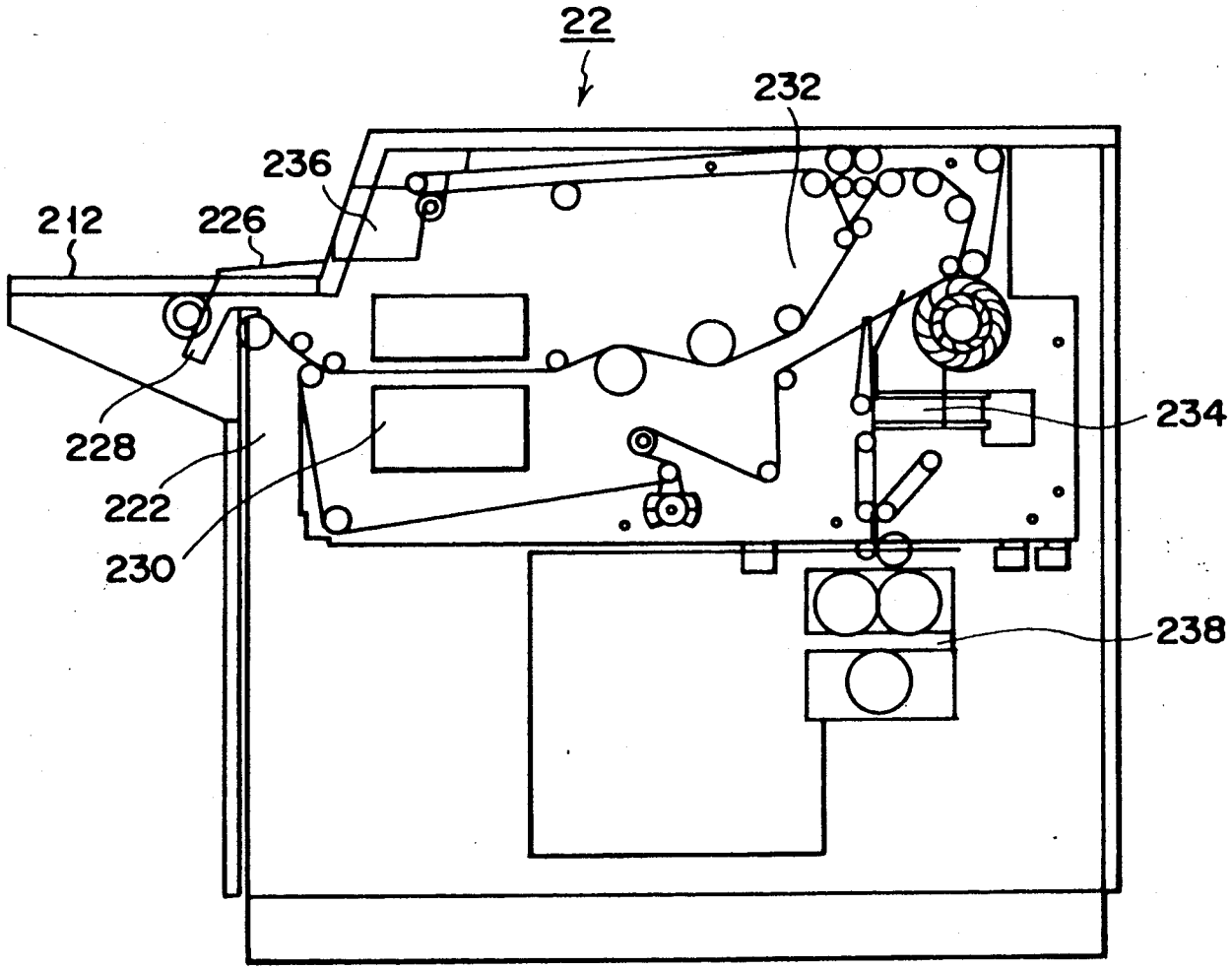
FIG. 15 is a schematic sectional view of a rejectable table note processing unit portion of the rejectable note processor.

A detailed arrangement of rejectable note processor 22 will be described with reference to FIGS. 1 and 15.

As shown in FIG. 1, the external arrangement includes operator desk 212, operation unit 214 having a ten-key pad and the like, output means or printer 216, separator card processing unit 218, display unit 220 having output means, e.g., a CRT display, and rejectable note processing unit 222 for processing normal ones of rejectable notes taken out from rejectable note cassette 196.

Separator card processing unit 218 processes separator cards inserted in separator card insertion port 224, and has an arrangement as shown in a block in FIG. 2B. More specifically, unit 218 comprises separator card take-out section 218A for taking out and conveying inserted separator card CAD, card number reading unit 218B for reading a code (card number) from the taken-out separator card, and separator card stocking unit 218C for simultaneously stocking separator cards whose card numbers are read.

Rejectable note processing unit 222 will be described with reference to the schematic sectional view of rejectable note processor 22 shown in FIG. 15.

Rejectable note processing unit 222 has rejectable card insertion port 226, note feeding unit 228, detecting unit 230, convey/sorting unit 232, unfit note temporary holding unit 234, rejectable note temporary stocking unit 236, unfit note shredder 238, counting unit 240, controller 241, I/O interface 242, and the like. More specifically, rejectable notes inserted in insertion port 226 are fed to detecting unit 230 one by one by note feeding unit 228. Detecting unit 230 reexamines the fed rejectable notes. Convey/sorting unit 232 sorts the notes into two types based on the detection result. For example, detecting unit 230 detects overlapping notes and authenticity of conveyed notes, and the notes are sorted into predetermined stocking units based on the detection result. More specifically, the notes are sorted into unfit notes and rejectable notes such as counterfeit notes, different denomination notes, and overlapping notes, and the like. The unfit notes are stocked in unfit note temporary holding unit 234. Rejectable notes which are determined as a result of detection by detecting unit 230 to be rejected (overlapping notes, counterfeit notes, different denomination notes) are stocked in rejectable note temporary stocking unit 236. When the count result from detecting unit 230 is compared with the count result from counting unit 240, and no abnormality is found, the unfit notes stocked in unfit note temporary holding unit 234 are invalidated by unfit note shredder 208. Counting unit 240 counts the numbers of notes stocked in stocking unit 236 and holding unit 234 independently of detecting unit 230. I/O interface 242 is arranged to perform data exchange with center console 20.

When a separator card is inserted in insertion port 224 of separator card processing unit 218, a detection result of a batch (to be described later) corresponding to a card number read from the inserted separator card is read out from memory unit 244 of center console 20 (to be described later in detail), and is displayed on display unit 220 of rejectable note processor 22. In the display content, rejection reasons of rejectable notes are displayed to correspond to the numbers of bands and straps.

The arrangement of respective units of paper sheet processing apparatus 10 will be described with reference to FIGS. 2A and 2B.

Bundle processor 12 has uninspected bundle inserting base 24, bundle take-out unit 26, 10-sheaf counting units 28a and 28B, inserted bundle rejecting unit 30, received bundle rejecting unit 32, seal stocking unit 34, inspected bundle receiving base 36, operation display panel 40, and the like, which have already been described above. Bundle processor 12 also has I/O interface 246 for performing data exchange with center console 20.

Pre-processor 16 comprises bundle feeding unit 248 for receiving and feeding bundle T conveyed along conveyor 18, band numbering unit 250 for printing identification data, e.g., serial numbers (band numbers) on bands of fed bundles T, band cutting unit 252 for removing the numbered bands, band holding cassette (which is detachable from the apparatus by an operator) 136 for stocking cut bands, strap cutting unit 146 for sequentially taking out sheaves one by one from 10 sheaves, vertically curving the sheaf to unbind it, and cutting the strap by a cutter while the sheaf is vertically curved, and strap band holding cassette 166 for sequentially storing cut straps, bundling 10 sheaves of straps by a heat-seal strap, and then storing and holding the bundle.

Serial numbers (strap numbers) are printed by strap printer 158 on straps of 10 sheaves which are stored in strap holding cassette 166 and bound by heat-seal bands at a predetermined pitch. However, since a strap for every 10 sheaves is bound by a single heat-seal band, the strap number need not always be printed on the strap of each of bound 10 sheaves, and a number may be printed on a strap portion of 10 sheaves located at, e.g., the upper end side.

As described above, notes taken out through processing operations by band cutting unit 252 and strap cutting unit 146 are sent to corresponding inspection device 14 one by one.

Each inspection device 14 has take-out unit 172, convey/sorting unit 174, inspection unit 176, sorting/stocking unit 178, sheaf binding unit 180, bundle binding unit 182, bundle packing unit 184, invalidation unit 186, control unit 188, and operation display unit 190, which have already been described above. Device 14 has counters 254 and 256 for respectively counting the numbers of fit notes and unfit notes in accordance with detection results from sensors 198 and 200, reading head 206D for reading a card number of separator card CAD, and reading head 208F for reading a cassette number of rejectable note cassette 196. Device 14 also has I/O interface 258 for performing data exchange with console 20.

Rejectable note processor 22 comprises operation unit 214, display unit 220, printer 216, note feeding unit 228, separator card processing unit 218, detecting unit 230, counting unit 240, temporary stocking unit 236, temporary holding unit 234, unfit shredder 238, controller 241, and I/O interface 242, which have already been described above.

Center console 20 comprises main controller 260 for controlling overall apparatus 10, operation unit 262 including, e.g., a keyboard, memory unit 244 including program memory 264 storing control programs, parameters, e.g., adjustment value data of respective units upon switching of denominations, and the like, of apparatus 10, and data memories 266a and 266b storing inspection data, and other data, CRT 268 for displaying acquired or stored inspection data and the like, I/O interface 270 for exchanging various data with bundle processor 12, inspection processing means (pre-processor 16 and inspection device 14), and rejectable note processor 22.

Note that above-mentioned data memories 266a and 266b have the same arrangement, and inspection data is stored in memories 266a and 266b. Normally, data memory 266a serves as a main memory and data is read out from data memory 266a during a collation operation or the like. However, when data memory 266a malfunctions, data memory 266b serves as a main memory, and is used for data read access.

Figure 16:
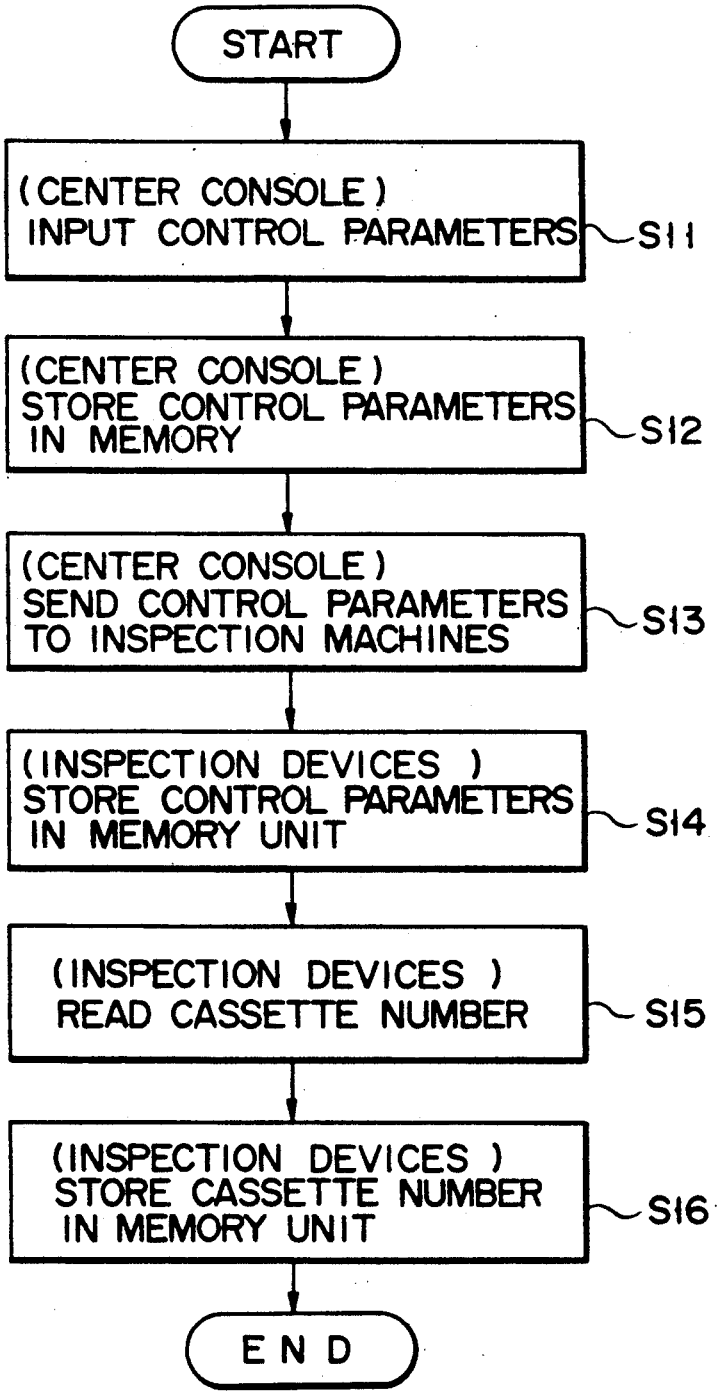
FIG. 16 is a flow chart of preparation processing in the apparatus shown in FIG. 1.

The operation of the paper sheet processing apparatus with the above arrangement will be described hereinafter. First, preparation processing as shown in the flow chart in FIG. 16 is performed. More specifically, the operator operates operation unit 262 of center console 20 to set various control parameters such as a denomination to be processed, a collation unit, a size of batch, and the like (step S11). Note that as the collation unit, one of one sheaf (100 notes), five sheaves (500 notes), and one bundle (1,000 notes) can be selected. In this embodiment, the collation unit is one bundle (10 sheaves, 1,000 notes), and one batch corresponds to 20 bundles. These control parameters are stored in data memory 266 (step S12). These control parameters are also output to inspection devices 14 through I/O interface 270 (step S13). In each inspection device 14, these control parameters are received through I/O interface 258, and are stored in memory unit 192 of control unit 188 (step S14). In each inspection device 14, the cassette number of loaded rejectable note cassette 196 is read by reading head 208F, and the read cassette number is stored in memory unit 192 (step S15).

After the preparation processing is completed in this manner, the operator places 10 bundles on each shelf 42 of bundle processor 12. When a processing start button (not shown) of operation display panel 40 is depressed, main controller 260 of center console 20 detects this through I/O interfaces 246 and 270, and instructs start of operations to the respective units In this case, the operation is started in response to not the depression of the processing start button of operation display panel 40 but depression of a predetermined key on operation unit 262 of center console 20.

Figure 17:
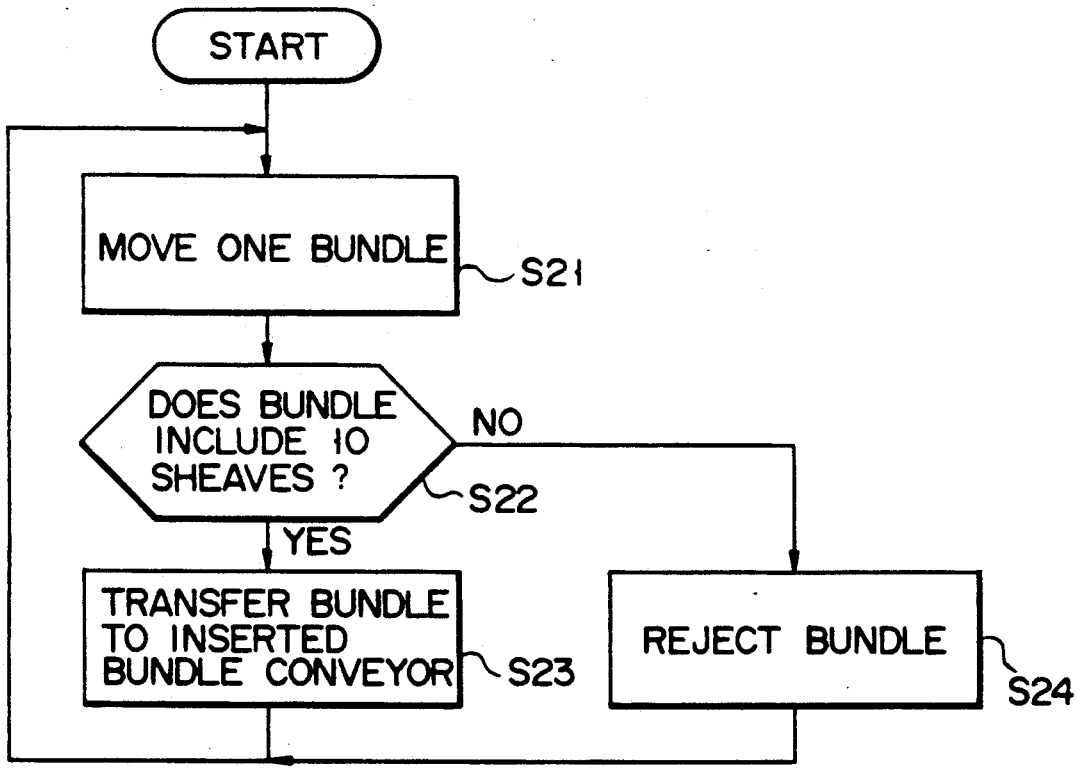
FIG. 17 is a flow chart for explaining a bundle feed operation in the bundle processor.

In accordance with the operation start instruction, bundle processor 12 performs a bundle feeding operation shown in the flow chart of FIG. 17. More specifically, as has been described above in detail, 10 bundles placed on each shelf 42 are moved one by one on the corresponding shelf 42 (step S21). It is then checked using 10-sheaf counting unit 28*a* arranged near bundle conveyor 60 if each bundle includes 10 sheaves (step S22). If YES in step S22, the bundle is transferred and fed to inserted bundle conveyor 66 (step S23). Movement of the next bundle and checking of 10 sheaves are repeated. However, if NO in step S22, the corresponding bundle is rejected (step S24).

Figure 18:
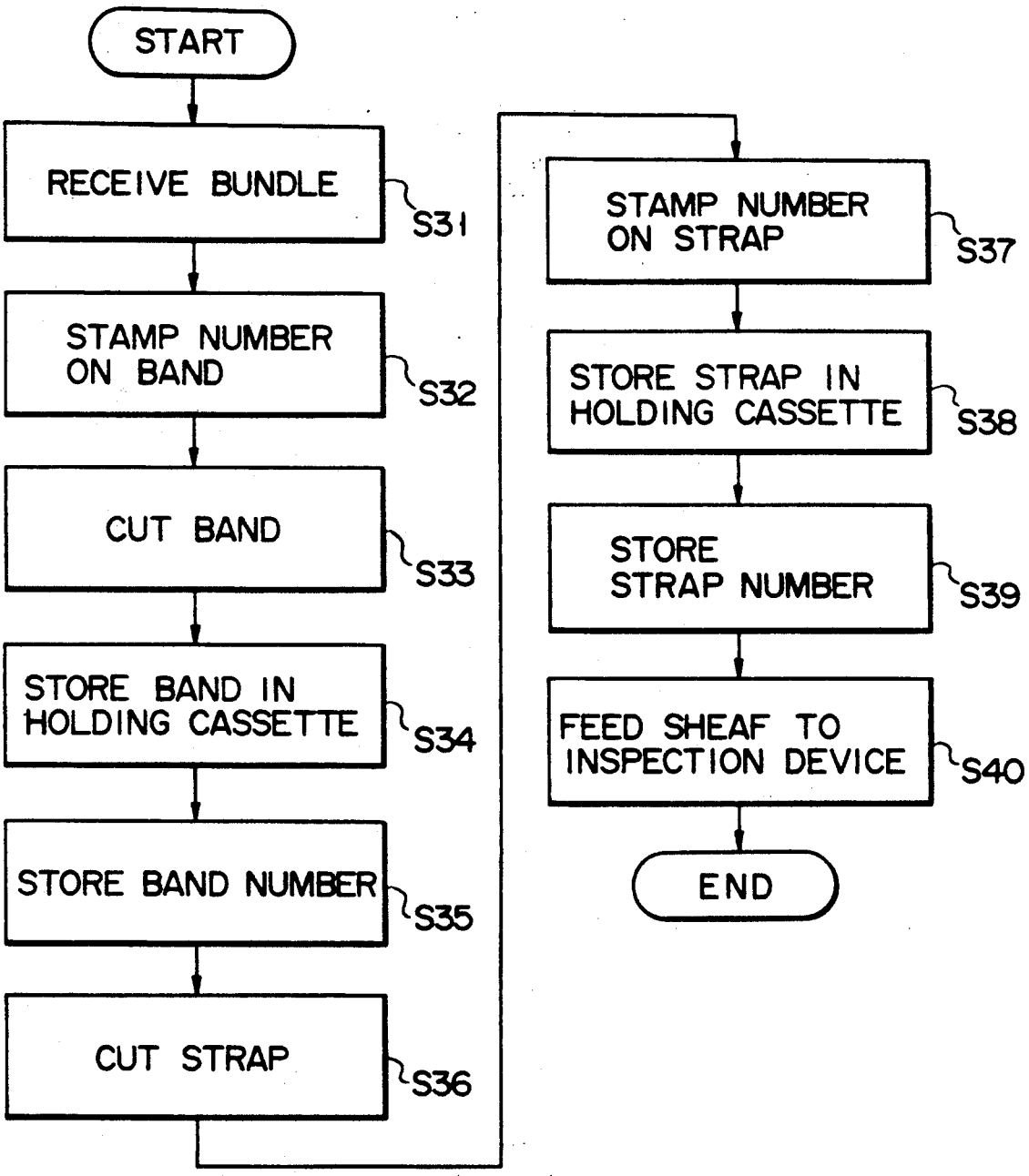
FIG. 18 is a flow chart for explaining a pre-processing operation in the pre-processor.

In the pre-processor, the pre-processing operation shown in the flow chart of FIG. 18 is performed. More specifically, when the bundle is fed from inserted bundle conveyor 66, the pre-processor receives the bundle (step S31), and stamps a serial number on the bands binding the bundle by band serial number printer 124 (step S32). In this case, a branch name of the bank, a name of a personnel of the bank, a date, and the like can be set as the parameters, so that index data including such information can be printed on the band. Then, the band is cut (step S33), and the cut band is stored in band holding cassette 136 (step S34). In this case, the band number is corresponded to the batch, and stored in memory unit 192 of corresponding inspection device 14 (step S35).

Then, straps of the sheaves are cut (step S36). Serial numbers are printed on the cut straps by strap printer 158 (step S37). The cut straps are stored in strap holding cassette 166 (step S38). In this case, the strap numbers are also corresponded to the batch, and stored in memory unit 192 of corresponding inspection device 14 (step S39). In this manner, 10 straps which are sequentially separated and removed are stored in strap holding cassette 166. Sheaves from which the straps are removed by pre-processor 16 are fed to corresponding inspection device 14 (step S40).

Figure 19A:
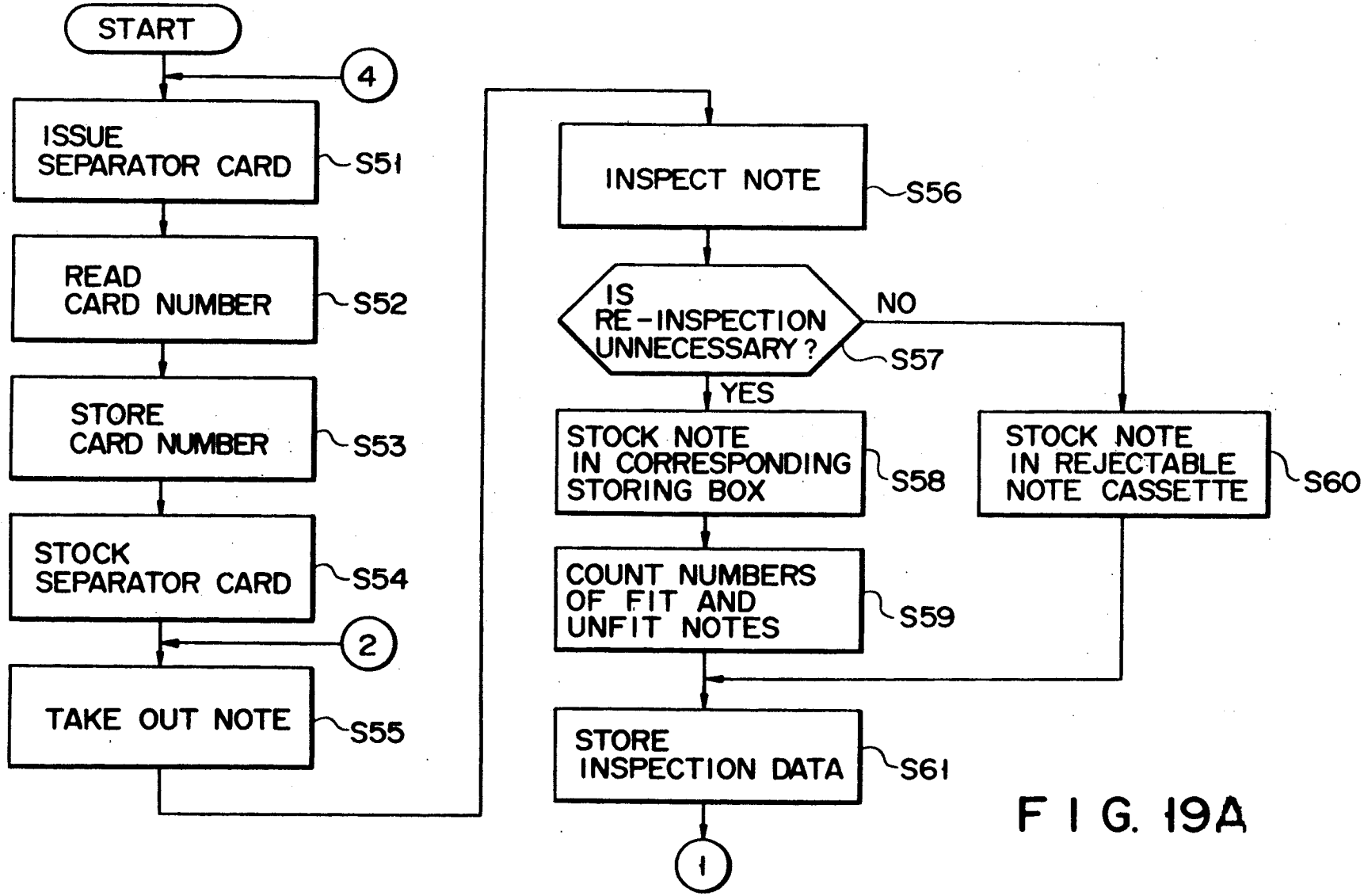
FIGS. 19A to 19C are flow charts for explaining inspection processing in the inspection device.
Figure 19B:
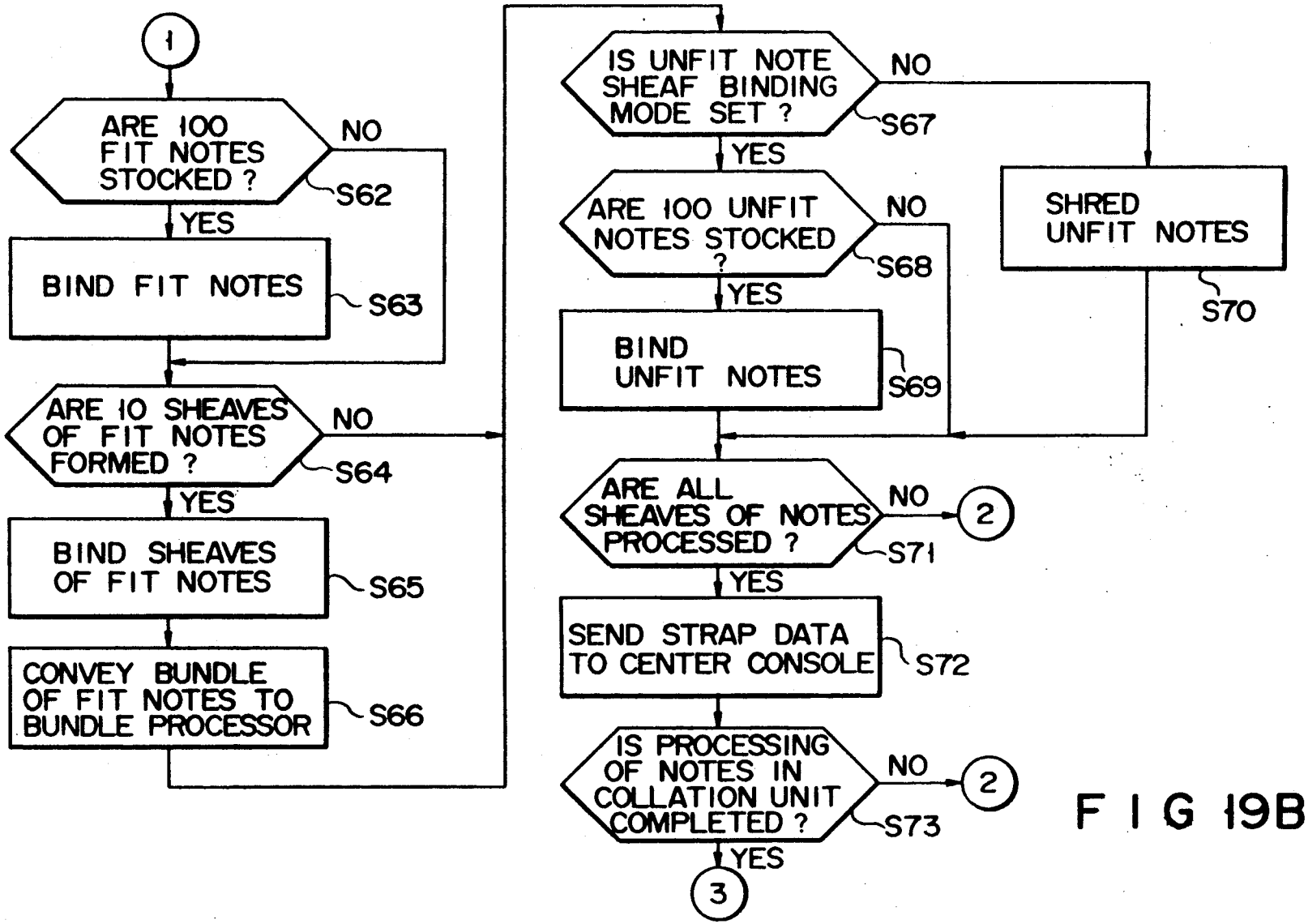
Figure 19C:
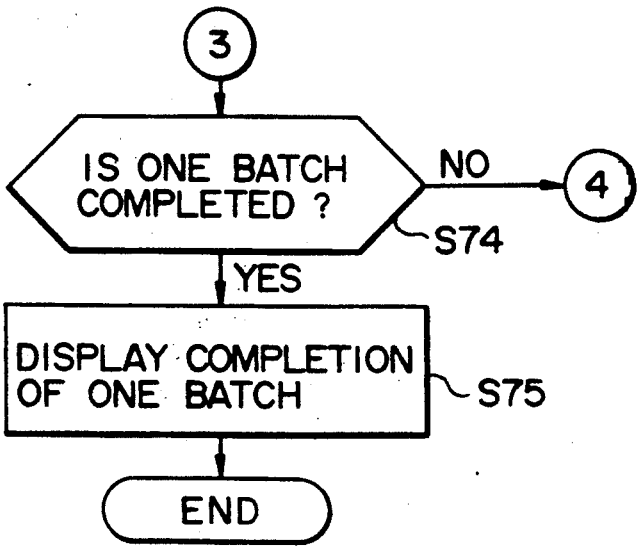

In each inspection device 14, inspection processing shown in the flow charts of FIGS. 19A to 19C is performed. That is, before the note take-out operation by take-out unit 172 is started, separator card CAD is issued by separator card issuer 206 (step S51). In this case, the card number of separator card CAD is read by reading head 206D (step S52). The card number read from this separator card CAD is stored in memory unit 192 in correspondence with the batch (step S53). Separator card CAD is then stocked in rejectable cassette 196 before rejectable notes are rejected in this batch (step S54).

Notes are taken out by take-out unit 172 one by one (step S55), and are subjected to inspection of authenticity, fit/unfit notes, detection of denominations, detection of overlapping notes, and the like through inspection unit 176 (step S56). As a result of detection, if the note does not require re-inspection (e.g., fit note, unfit note) (step S57), the note is conveyed to and stocked in corresponding one of stocking boxes BIN3 and BIN4 by convey/sorting unit 174 (step S58). In this case, the numbers of fit and unfit notes are counted by counters 254 and 256, respectively (step S59). Note that stocking box BIN2 stocks fine notes (super fit notes) when an instruction is generated from center console 20.

As a result of detection, if the note requires reinspection (overlapping notes, counterfeit note) (step S57), the note is conveyed to rejectable note stocking unit 178A by convey/sorting unit 174, and is stacked an stored on separator card CAD in rejectable note cassette 196 (step S60).

The content of inspection in inspection unit 176 (e.g., rejection reasons of rejectable notes and corresponding number of notes) and inspection data such as the numbers of fit and unfit notes obtained by counters 254 and 256 are stored in memory unit 192 (step S61).

Notes which are determined as fit notes as a result of inspection are stocked in stocking box BIN3 of fit note sorting/stocking unit 178C (step S62). When 100 fit notes are stocked (step S62), these notes are bound and stamped by fit note binding unit 180C (step S63). In this manner, inspection of bound sheaves, i.e., presence/absence of an offset of notes is checked. In this case, the offset of notes is detected, warning indicating this is made to an operator, and operator manually corrects this. When 10 sheaves of fit notes are obtained (step S64) bundle binding unit 182 binds these sheaves of notes (step S65). Note that the bundle of fit notes is conveyed to bundle processor 12 through conveyor 18 (bundle conveyor 80) (step S66).

Figure 20:
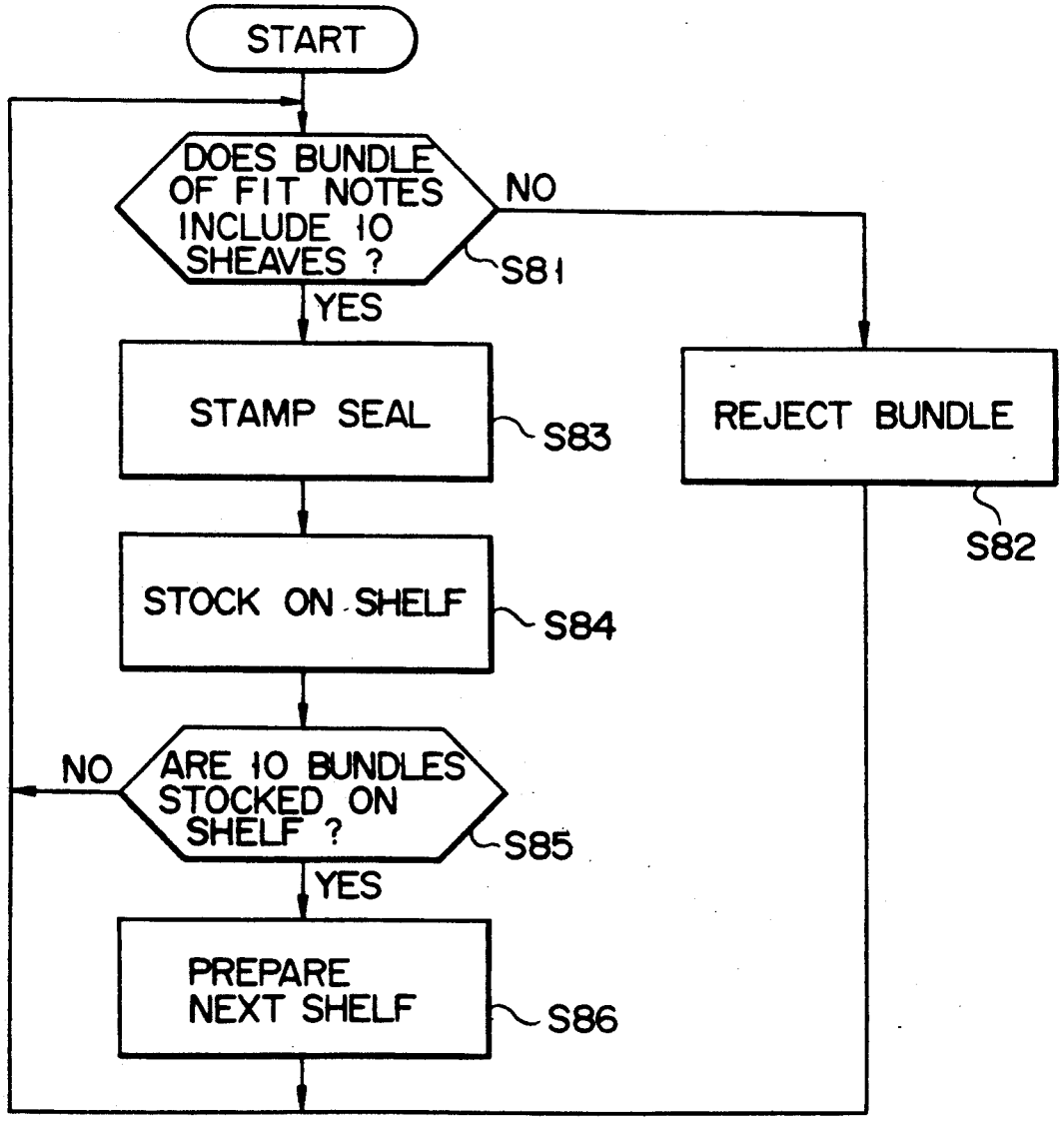

Upon reception of the conveyed bundle, bundle processor 12 performs a bundle reception operation shown in the flow chart of FIG. 20. More specifically, as has been described above in detail, it is detected using 10-sheaf counting unit 28*b* arranged near bundle conveyor 80 if the bundle includes 10 sheaves (step S81). If NO in step S81, the bundle is rejected (step S82). However, if YES in step S81, a seal is stamped by stamper 86 (step S83), and is stacked on shelf 90 (step S84). Each time 10 bundles are stacked on one shelf 90 (step S85), shelves 90 are rotated (step S86), thus allowing continuous stocking operation. Thereafter, these bundles are taken out by the operator, and the subsequent processing is performed.

Notes which are determined as unfit notes as a result of inspection by inspection device 14 are stocked in stocking box BIN4 of unfit note sorting/stocking unit 178D. In this case, one of a unfit note sheaf binding mode and an unfit note temporary holding mode for shredding unfit notes is selected and executed. When the unfit note sheaf binding mode is selected (step S67), each time 100 unfit notes are stocked (step S68), these notes are bound and stamped by unfit note binding unit 180D, and the bound sheaf is stocked in a reception box of an unfit note sheaf stocking unit (not shown) (step S69).

On the other hand, when the unfit note temporary holding mode is selected (step S67), invalidation unit 186 shreds the unfit notes (step S70). The shredded chips are exhausted into discard box 186C.

It is then checked if all the notes of sheaves are processed (step S71). If NO in step S71, the flow returns to step S55, and the processing of the next note is performed. If YES in step S71, control unit 188 sends strap data (to be described later) to center console 20 through I/O interface 258 (step S72). It is then checked if processing of one collation unit (one bundle) is completed (step S73). If NO in step S73, the flow returns to step S55. and the processing of the next note is performed. If YES in step S73, it is then checked if processing of one batch is completed (step S74). If NO in step S74, the flow returns to step S51, and processing of the next collation unit is performed. However, if YES in step S74, a message indicating this is displayed on CRT 190C (step S75), and inspection processing is ended.

The strap data which is sent to center console 20 each time inspection device 14 completes processing of sheaves is as shown in FIG. 21. More specifically, the strap data includes machine No. data, RUN-No. data, BATCH-No. data, CASSET-No. data, CARD-No. data, BUNDLE-No. data, STRAP-No. data, FIT-NOTE data, UNFITNOTE data, and the like. The machine No. data is data of an inherent number indicating corresponding inspection device 14 in paper sheet processing apparatus 10. The RUN-No. data is data of a number provided for each processing mode. This data is preset at center console 20 by the operator, and a predetermined number is provided in accordance with denominations or collation units. The BATCH-No. data is data of a number provided to each batch of processing, and is automatically generated. Note that an amount of one batch is preset at center console 20 by the operator.

The CASSET-No. data is data of a number of rejectable note cassette 196 presently set in this inspection device 14. More specifically, this data is read by reading head 208F, and is stored in memory unit 192. The CARD-No. data is data of a number of separator card CAD which is issued for each collation unit. More specifically, this data is read by reading head 206D and is stored in memory unit 192. The BUNDLE-No. data is data of a number of a band of a processed bundle That is, this data is printed on the band by band serial number printer 124 and is stored in memory unit 192. The STRAP-No. data is data of a number of a strap of a processed sheaf. More specifically, this data corresponds to a strap number which is printed on a cut strap by strap printer 158 and is store in memory unit 192 when a 100-note collation mode is designated at center console 20.

The FIT-NOTE data is data indicating the number of fit notes in a processed sheaf. The UNFIT-NOTE data is data indicating the number of unfit notes in a processed sheaf. These data are counted by counters 254 and 256, and are stored in memory unit 192.

FIG. 22 schematically shows data flow among center console 20, inspection devices 14, and rejectable note processor 22. More specifically, each time inspection devices 14 (CP1, CP2, CP3) complete processing of sheaves, they supply strap data ① described above to center console 20. Center console 20 creates strap log data based on machine No. data, RUN-No. data, and BATH-No. data in the strap data ①, and saves the data in a predetermined area of data memory 266, as shown in FIG. 23. FIG. 24 shows the strap log data in detail. In FIG. 24, portion 272 enclosed by a broken line corresponds to one strap data ① transmitted from each inspection device 14 each time sheaf processing is completed, and portion 274 enclosed by a solid line corresponds to one bundle (one collation unit). As can be understood from FIG. 24, each time processing of one bundle is completed, separator card CAD is issued. In addition, the card number of separator card CAD need not be a serial number. Note that DATE and TIME in FIG. 24 indicate a date and time when the strap data is received. When FIT+UNFIT is not equal to 100, it does not always indicate that rejectable notes were present. More specifically, it can be considered that the processed bundle did not include 100 notes from the beginning. This decision can be made by arranging rejectable notes later.

When processing of one batch is completed, rejectable notes and separator cards CAD are stocked in rejectable note cassette 196, as shown in FIG. 25. This cassette 196 is manually conveyed to rejectable note processor 22, as indicated by a broken line in FIG. 22. More specifically, when processing at inspection device 14 is completed, rejectable notes stored in rejectable note cassette 196 through rejectable note processor 22 are arranged. The rejectable note arranging operation is not fully automatically performed but is performed such that rejectable note processor 22 assists manual inspection.

The rejectable note arranging operation will be described hereinafter with reference to the flow charts of FIGS. 26A to 26C. In this case, one batch corresponds to one cassette. More specifically, if processing of one batch is completed in any inspection device 14 (step S91), the operator unloads rejectable note cassette 196 from inspection device 14 (step S92), and carries it on operator desk 212 of rejectable note processor 22. The operator designates the cassette number of cassette 196 in processor 22 using operation unit 214 (step S93).

Processor 22 then supplies cassette number data ② (FIG. 22) to center console 20 (step S94). In accordance with the cassette number data ②, center console 20 edits collation count data ③ based on strap log data stored in the predetermined area of data memory 266, and sends the edited data to processor 22 (step S95). Processor 22 receives the collation count data ③ (step S96), and stores it therein. The collation count data ③ includes RUN-No. data, CASSET-No. data, CARD-No. data, BATCH-No. data, BUNDLE-No. data, FIT+UNFIT data, and the like as shown in FIG. 27. In FIG. 27, portion 276 enclosed by a solid line corresponds to portion 274 enclosed by the solid line in FIG. 22. In the 100-note collation mode, the above-mentioned collation data includes the STRAP-No. data described above.

The operator then sequentially takes out rejectable notes and separator cards CAD in rejectable note cassette 196 from upper ones, and processes them. Thus, rejectable notes in cassette 196 are inspected regardless of a processing speed of inspection device 14. More specifically, the operator takes out notes in the collation unit sorted by separator card CAD, and manually inspects them (step S97). If the operator determines as a result of inspection that there are abnormal notes such as different denomination notes or counterfeit notes (step S98), he key-inputs the number of abnormal notes at operation unit 214 (step S99). The operator then inserts other rejectable notes into rejectable note inspection port 226 of processor 22 (step S100).

Processor 22 then takes out inserted rejectable notes one by one (step S101), so that overlapping, different denomination, counterfeit notes, and the like are detected by detecting unit 230 (step S102). If these notes are included (step S103), they are rejected into rejectable note temporary stocking unit 236 as rejectable notes (step S104), and are then subjected to manual inspection.

If the notes are not ones to be rejected in the manner described above, these notes are stocked in unfit note temporary holding unit 234, and thereafter, are shredded (step S105). In addition, the number of the notes is counted (step S106). When all the inserted notes in one collation unit are taken out and counted (step S107), separator card CAD is inserted in sorting card insertion port 224 of separator card processing unit 218 (step S108), and a card number of inserted sorting card CAD is read (step S109). Note that the sorting card whose number is read is stocked in a card reception box (not shown), and is reused in inspection device 14.

Data for one bundle corresponding to the read card number is fetched from the stored collation count data ③ (step S110), and collation is performed based on the fetched data and the count result in step S107 (step S111). More specifically, it is checked if a total of the number of fit and unfit notes and the number of notes processed by processor 22 is equal to the number of the predetermined collation unit (1,000).

Collation result data ④ is generated based on the collation result, and is sent to center console 20 (step S112). The collation result data 4 includes CASSET-No. data, CARD-No. data, BATCH-No. data, BUNDLE-No. data, FIT+UNFIT data, RS-NOTE data, OVER data, SHORT data, D1K data, D5K data, D10K data, counterfeit note data, and the like. Of these data, the RS-NOTE data is data indicating the number of notes processed by processor 22. The OVER and SHORT data are data indicating the number of notes that the collation result (the total of the number of fit and unfit notes and the number of notes processed by processor 22) exceeds or is short from the number of the predetermined collation unit (1,000). The D1K data, D5K data, and D10K data, and counterfeit note data are data indicating the numbers of different denomination notes and counterfeit notes key-input by the operator in step S99. "D1K" means Y 1,000 notes, "D5K" means Y 5,000 notes and "D10K" means Y 10,000 notes.

As a result of collation by processor 22, if an abnormality is detected (difference in counts, mixing of different denomination notes, mixing of counterfeit notes, or the like) (step S113), an accident slip ⑤ is issued by printer 216 based on the collation result data ④ (step S114). On the accident slip ⑤, band data is recorded, as shown in FIG. 29, and an abnormal bundle (sheaf) can be specified based on this. The operator takes out the corresponding band from band holding cassette 136 based on the band data, and can confirm a name of the financial organization and reception data printed on the band.

When all the rejectable notes and separator cards CAD are taken out from rejectable note cassette 196 (step S115), the rejectable note arranging operation for one batch is completed. Thus, the operator unloads the next cassette 196 from another inspection device 14 which has completely processed the batch, and starts a new rejectable note arranging operation.

Note that band printer 124 comprises, in its main body 278, case 280, guide shaft 282 horizontally arranged at substantially the central portion of case 280, slidable cylinder 284 slidably fitted in guide shaft 282, ink-jet printer head 286 communicating with slidable cylinder 284, and drive mechanism 288 arranged along guide shaft 282, as shown in FIG. 30. Drive mechanism 288 has a pair of pulleys 290*a* and 290*b*, belt 292 looped between pulleys 290*a* and 290*b*, and communicating member 294 attached to belt 292 and communicating with slidable cylinder 284. Mechanism 288 causes a drive motor (not shown) to drive belt 292, thereby moving printer head 286 in a direction indicated by an arrow in FIG. 30.

Printer main body 278 is pivoted by pivoting mechanism 296. Pivoting mechanism 296 comprises pivoting arm 298 one end portion of which is attached to one side surface of printer main body 278, and the other end portion of which is attached to shaft 300, driven gear 302 fixed to a projecting end portion of shaft 300, motor 304 serving as a drive source, and driving gear 306 fixed to the driving shaft of motor 304 and meshed with driven gear 302, as shown in FIG. 31. Upon rotation of motor 304, printer main body 278 is pivoted in an $\alpha 1$ or $\alpha 2$ direction in a 90° range.

Note that strap printer 158 has the similar arrangement to that of band serial number printer 124.

The operation of band serial number printer 124 with the above arrangement will be described below.

As described above, when bundle T is conveyed to the position (B) and is stopped, pivoting mechanism 296 of band serial number printer 124 starts its operation to move printer main body 278 in the $\alpha 1$ direction. Thus, a head surface of printer head 286 in printer main body 278 opposes lateral band K1 of bands K of bundle T at a small distance, as shown in FIG. 32. From this state, drive mechanism 288 of printer main body 278 is operated to move printer head 286 in the direction of the arrow in FIG. 30. In this case, ink is injected from the head surface of printer head 286 toward lateral band K1, thereby printing the above-mentioned identification data on lateral band K1.

Pivoting mechanism 296 causes printer main body 278 to pivot through 90° in the $\alpha 2$ direction, so that the head surface of printer head 286 in printer main body 278 opposes vertical band K2 at a small distance. In the same manner as described above, the identification data is printed on vertical band K2, as shown in FIG. 33.

During the printing operation of band serial number printer 124, the printing operations on lateral and vertical bands K1 and K2 by printer head 286 are performed in a non-contact state. Therefore, even if bands K1 and K2 are in an unstable state due to misregistration of sheaves t, clear identification data can be printed, and the subsequent inspection processing can be facilitated.

As described above, cut strap k has reached a position, which is below strap printer 158 and on band convey belt 160, by catch 156. Since printer 158 has the same arrangement as that of printer 124, identification data is printed on strap k by a printer head (not shown) in a non-contact state, as shown in FIGS. 34A and 34B. In this case, clear identification data can be printed on strap k, and the subsequent inspection processing can be facilitated.

The rejectable note cassette as the rejectable note storing unit, and a cassette loading/unloading section for loading/unloading the rejectable note cassette will be described hereinafter with reference to FIGS. 35A to 35C.

FIGS. 35A and 35B show in detail rejectable note cassette 196. FIG. 35A is a front view of rejectable note cassette 196, and FIG. 34B is a rear view. Rejectable note cassette 196 shown in FIGS. 35A and 35B has a rectangular outer shape, and has door 308 which is openably/closably supported by hinges 310 on its operation surface side. Handles 314L and 314R used for a loading/unloading operation is provided at two outer side surfaces of main body 312. Identification data generating unit 318 is arranged on rear surface 316, as shown in FIG. 35B.

Identification data generating unit 318 comprises four permanent magnets 318*a* to 318*d*. Upon combinations of N and S poles of the permanent magnets, 16 different identification data can be generated.

A cassette loading/unloading section, on the side of inspection device 14, for loading/unloading rejectable note cassette 196 is arranged as shown in FIG. 35C.

Cassette loading/unloading section 320 of cassette stocking unit 208 of inspection device 14 has a shape and size large enough to store rejectable note cassette 196. Reading unit 324 for reading identification data is provided on deep portion 322 in correspondence with four permanent magnets 318*a* to 318*d* constituting identification data generating unit 318 provided to rejectable note cassette 196.

Reading unit 324 comprises four magnetic sensors 324*a* to 324*d* provided at positions corresponding to permanent magnets 318*a* to 318*d* arranged on rear surface 316 of rejectable note cassette 196 when rejectable note cassette 196 is loaded.

When rejectable note cassette 196 is inserted in cassette loading/unloading section 320 from the side of rear surface 316, it can be identified based on combinations of N and S poles of permanent magnets 318*a* to 318*d*, that is, a cassette number can be read. The identification data is sent to memory unit 244 of center console 20. Note that the identification data generating unit is not limited to one described in this embodiment, but may comprise a combination of a plurality of three-dimensional patterns or a bar code. In this case, the reading unit of the inspection device must be arranged correspondingly.

As has been described above, inspection processing, various processing operations for inspected paper sheets, various processing operations for bands, collation processing of bands and paper sheets, and storing processing of an inspected bundle, starting from reception processing of an uninspected bundle, can be automatically, efficiently, and quickly performed.

Rejectable notes which must be re-inspected as a result of inspection by a plurality of inspection devices are processed by a rejectable note processor. Thus, even if a small number of rejectable notes are discharged from each inspection device, the processing power of the rejectable note processor can be fully exhibited as a whole. As a result, the overall apparatus can effectively function.

Note that the present invention is not limited to the above arrangement, and various changes and modifications may be made within the spirit and scope of the invention. In this embodiment, the collation unit corresponds to one bundle but may be one sheaf. In addition, one batch need not be 20 bundles.

What is claimed is:

1. A system for processing paper sheets, a first number of paper sheets being bound by at least one strap to form a sheaf, a second number of sheafs being bound by at least one band to form a bundle, comprising:

an input structure on which a first predetermined number of bundles may be placed;

take-out means for removing bundles one by one from the input structure;

insertion side conveying means for receiving bundles from the takeout means and conveying them in a first predetermined direction;

a plurality of inspecting apparatuses, each such inspecting apparatus including:

means for receiving bundles from the insertion side conveying means;

means for unbinding the paper sheets in the bundles by cutting and removing the bands binding the bundles and the straps binding the sheafs;

means for inspecting the paper sheets one by one;

means for sorting the sheets into reusable sheets, non-reusable sheets, and unidentifiable sheets based on the inspection;

means for counting the number of the reusable sheets in each sheaf and the number of non-reusable sheets in each sheaf;

means for wrapping at least one strap around the first number of reusable sheets to form an inspected sheaf;

means for wrapping at least one band around the second number of the inspected sheafs to form an inspected bundle; and means for discharging inspected bundles;

reception side conveying means for receiving inspected bundles from the inspection apparatuses and conveying the inspected bundles in a second predetermined direction;

an output structure upon which the first predetermined number of inspected bundles can be placed;

take-in means for receiving the inspected bundles from the reception side conveying means and for stacking the inspected bundles on the output structure;

controller means, electrically connected to each inspecting apparatus, for receiving from said inspecting apparatuses and sequentially storing the number of non-reusable sheets in each sheaf and the number of reusable sheets in each sheaf; and unidentifiable sheet processor means, electrically connected to the controller means, for aiding an operator in the manual inspection of the unidentifiable sheets by fetching the number of reusable sheets in each sheaf and the number of non-reusable sheets in each sheaf from the controller means, by presenting information based on said numbers to the operator, and by counting the number of sheets determined not to be rejectable by the manual inspection.

2. A system for processing paper sheets, a first number of paper sheets being bound by at least one strap to form a sheaf, a second number of sheafs being bound by at least one band to form a bundle, comprising:

a plurality of inspecting apparatus, each such inspecting apparatus including:

means for inspecting a predetermined number of sheets to discriminate effective sheets and unidentifiable sheets;

means for sorting the sheets into effective and unidentifiable sheets based on the inspection;

means for counting the number of the effective sheets; and cassette means removeably associated with the inspecting apparatus for collecting the unidentifiable sheets;

controller means, electrically connected to each inspecting apparatus, for receiving from each inspecting apparatus the number of effective sheets, and for storing the number of effective sheets counted by each inspecting apparatus; and unidentifiable sheet processor means, electrically connected to said controller means and to each inspecting apparatus, receiving the cassette means from each inspecting apparatus, for determining the number of unidentifiable sheets in the cassette means, for fetching the counted number of effective sheets from said controller means, and for determining whether the sum of the number of unidentifiable sheets and the number of effective sheets is coincident with said predetermined number.

3. The apparatus according to claim 2 wherein:

the controller means also inputs a number of sheafs which defines a collation unit, a number of collation units making up the predetermined number of sheets; and each inspecting apparatus further comprises:

a means for preparing a bundle separator card, which prepares a separate bundle separator card for association with each bundle processed by the inspecting apparatus, each bundle separator card having at least a card identification code printed thereon for association with the bundle with which the bundle separator card is associated and for depositing each bundle separator card into said cassette means, the means for preparing a bundle separator card also prepares a separate collation unit separator card for association with each collation unit processed by the inspecting apparatus, each collation unit separator card having separator card identification data printed thereon for association with the collation unit with which the collation unit separator card is associated, the means for preparing a bundle separator card also deposits collation unit separator cards into the cassette means such that each collation unit separator card separates sheets from the collation unit with which it is associated from sheets of other collation units.

4. The apparatus according to claim 3 wherein:

the means for counting in each inspecting apparatus also counts the number of effective sheets in each bundle processed by the inspecting apparatus; and the controller means also stores the number of effective sheets in each bundle in one-to-one correspondence with the card identification code associated with that bundle.

5. The apparatus according to claim 4 wherein:

the cassette means of each inspecting apparatus carries a different cassette identification code;

each inspecting apparatus further comprises:

means for reading the cassette identification code from the cassette means when the cassette means is attached to the inspecting apparatus; and the controller means stores the number of effective sheets in a bundle in one-to-one correspondence with the card identification code and the cassette identification code.

6. The apparatus according to claim 2 wherein:

the unidentifiable sheet processor means further comprises:

means for invalidating the unidentifiable sheets when the sum of the number of unidentifiable sheets and the number of the effective sheets supplied from said controller means is coincident with said predetermined number of sheets.

7. A sheet processing apparatus for processing paper sheets, a first number of paper sheets bound by at least one strap to form a sheaf, a second number of sheafs bound by at least one band to form a bundle, comprising:

a plurality of inspecting apparatuses, each such inspecting apparatus including:

means for inspecting a predetermined number of sheets in order to discriminate effective sheets and unidentifiable sheets;

means for sorting the sheets into effective sheets and unidentifiable sheets based on the inspection;

means for counting the number of the effective sheets;

means for preparing a bundle separator card for association with said unidentifiable sheets on which at least a card identification code is recorded; and cassette means for collecting the unidentifiable sheets and the bundle separator card, the cassette means having a cassette number;

controller means, electrically connected to each inspecting apparatus, for sequentially receiving and storing the counted number of effective sheets supplied from said plurality of inspecting apparatuses; and unidentifiable sheet processor means, electrically connected to each inspecting apparatus and to said controller means, for inputting a cassette number, for sequentially processing unidentifiable sheets in the cassette means and for determining the number of the unidentifiable sheets in the cassette means, for automatically reading the card identification code, for sending at least the card identification code to said controller means to receive the number of effective sheets in said predetermined number of sheets back from the controller means, and for determining whether the sum of the number of the received unidentifiable sheets in the cassette means and the number of the effective sheets supplied from said controller means is coincident with said predetermined number of sheets.

8. The apparatus according to claim 7 wherein:

the means for counting in each inspecting apparatus also counts the number of effective sheets in each bundle which were processed by the inspecting apparatus; and the controller means also stores the number of effective sheets in each bundle in one-to-one correspondence with the card identification code associated with that bundle.

9. The apparatus according to claim 8, wherein:

the cassette means of each inspecting apparatus carries a different cassette identification code;

each inspecting apparatus further comprises:

means for reading the cassette identification code from the cassette means when the cassette means is attached to the inspecting apparatus; and the controller means stores the number of effective sheets in a bundle in one-to-one correspondence with the card identification code and the read cassette identification code.

* * * * *